US008233832B2

(12) United States Patent
Gon

(10) Patent No.: US 8,233,832 B2
(45) Date of Patent: Jul. 31, 2012

(54) FIXING UNIT AND IMAGE FORMING APPARATUS WITH THE SAME

(75) Inventor: Syoukou Gon, Osaka (JP)

(73) Assignee: Kyocera Mita Corporation (JP)

( * ) Notice: Subject to any disclaimer, the term of this patent is extended or adjusted under 35 U.S.C. 154(b) by 224 days.

(21) Appl. No.: 12/859,027

(22) Filed: Aug. 18, 2010

(65) Prior Publication Data

US 2011/0052281 A1 Mar. 3, 2011

(30) Foreign Application Priority Data

Aug. 31, 2009 (JP) ..... 2009-200927

(51) Int. Cl.
*G03G 15/20* (2006.01)

(52) U.S. Cl. ..... 399/329; 219/619; 399/334

(58) Field of Classification Search ..... 399/328, 399/329, 334; 219/216, 619
See application file for complete search history.

(56) References Cited

U.S. PATENT DOCUMENTS

| | | | | |
|---|---|---|---|---|
| 7,835,680 | B2 * | 11/2010 | Nanjo et al. | 399/329 |
| 2007/0014599 | A1 * | 1/2007 | Yasuda et al. | 399/328 |
| 2009/0142114 | A1 | 6/2009 | Yasuda et al. | |
| 2009/0175664 | A1 | 7/2009 | Nanjo et al. | |
| 2009/0245898 | A1 * | 10/2009 | Gon et al. | 399/328 |

FOREIGN PATENT DOCUMENTS

WO WO 2006/054658 5/2006

* cited by examiner

*Primary Examiner* — Sophia S Chen
(74) *Attorney, Agent, or Firm* — Gerald E. Hespos; Michael J. Porco

(57) ABSTRACT

A fixing unit for fixing a toner image onto a sheet passing between a first element and a second element pressed against the first element includes a looped coil surface formed with a coil so that the coil surface generates a magnetic field for induction-heating the first element, the coil surface including an inner edge defining an opening region; an upright wall disposed inside the opening region, an opening being formed in the upright wall; a center core disposed along the opening region, the center core including a conductive shaft and a magnetic tube configured to at least partially cover the conductive shaft; and a nonconductive cap inserted into the opening, the nonconductive cap partially covering the conductive shaft to electrically insulate the coil from the conductive shaft.

18 Claims, 22 Drawing Sheets

FIXING UNIT AND IMAGE FORMING APPARATUS WITH THE SAME

BACKGROUND OF THE INVENTION

1. Field of the Invention

The present invention relates to a fixing unit configured to fix a toner image on a sheet, and to an image forming apparatus with the fixing unit.

2. Description of the Related Art

Heating by electromagnetic induction is more rapid and efficient heating manner. Therefore, heating by electromagnetic induction (hereinafter called "induction-heating" or "IH") is used for various apparatuses. For example, a particular image forming apparatus comprises an induction-heating type of a fixing apparatus.

A distance between a magnetic body through which a magnetic flux passes and an object to be induction-heated in an induction-heating type of an apparatus is a very important parameter. For example, in the case of the induction-heating type of the fixing apparatus, variation in the distance between the magnetic body and the object to be induction-heated results in irregular temperature over the object, which in turn leads to degrading a toner image fixed on a sheet. A particular fixing apparatus comprises a magnetic tube configured to cover a shaft. The magnetic tube is coaxially disposed inside a roller configured to fix an image to keep a consistent distance between the magnetic tube and the roller. The shaft is typically made of metal to reduce twisting of the shaft.

A current flows in a coil during induction-heating. The shaft of the fixing apparatus described above is separated by a sufficient distance from the coil. Consequently, the current is less likely to leak into the shaft. However, if a fixing apparatus including a metal shaft comprises a magnet body closer to a coil, it is required to electrically insulate the coil from the metal shaft.

SUMMARY OF THE INVENTION

The present invention to overcome the drawback of the prior art directs to provide a fixing unit with an electrical insulating structure between a shaft and a coil, and an image fixing apparatus with the fixing unit.

A fixing unit according to one aspect of the present invention to fix a toner image onto a sheet passing between a first element and a second element pressed against the first element, includes: a looped coil surface formed with a coil so that the coil surface generates a magnetic field for induction-heating the first element, the coil surface including an inner edge defining an opening region; an upright wall disposed inside the opening region, an opening being formed in the upright wall; a center core disposed along the opening region, the center core including a conductive shaft and a magnetic tube configured to at least partially cover the conductive shaft; and a nonconductive cap inserted into the opening, the nonconductive cap partially covering the conductive shaft to electrically insulate the coil from the conductive shaft.

An image forming apparatus configured to form a toner image on a sheet according to another aspect of the present invention includes: a fixing unit configured to fix the toner image on the sheet, wherein the fixing unit includes: a first element; a second element pressed against the first element; a looped coil surface formed with a coil so that the coil surface generates a magnetic field for induction-heating the first element, the coil surface including an inner edge defining an opening region; an upright wall disposed inside the opening region, an opening being formed in the upright wall; a center core disposed along the opening region, the center core including a conductive shaft and a magnetic tube configured to at least partially cover the conductive shaft; and a nonconductive cap inserted into the opening, the nonconductive cap partially covering the conductive shaft to electrically insulate the coil from the conductive shaft.

DETAILED DESCRIPTION OF THE PREFERRED EMBODIMENTS

A fixing unit and an image forming apparatus according to one embodiment are described below with reference to the accompanying drawings. Terms indicating directions such as "upper", "lower", "left" and "right" in the following description are simply used for clarification, and so do not limit the present invention in any way. Moreover, descriptions such as "a magnetic tube/a center core near a coil" and "a magnetic tube/a center core near a first element" or similar mean that the magnetic tube/the center core is disposed sufficiently near the coil or the first element so as to contribute to induction-heating. A description "a magnetism shielding plate is disposed near a coil surface" or similar, means that the magnetism shielding plate is placed sufficiently near the coil surface so as to impede magnetic induction of the coil. Furthermore, a term "looped" or similar used in the following description does not only refer to a perfect circular ring shape, but rather is a general term which encompasses an elliptical ring, a square ring, a polygonal ring shape or the like, to indicate any shape of an object defining a preferable closed region.

(Image Forming Apparatus)

Figure 1:
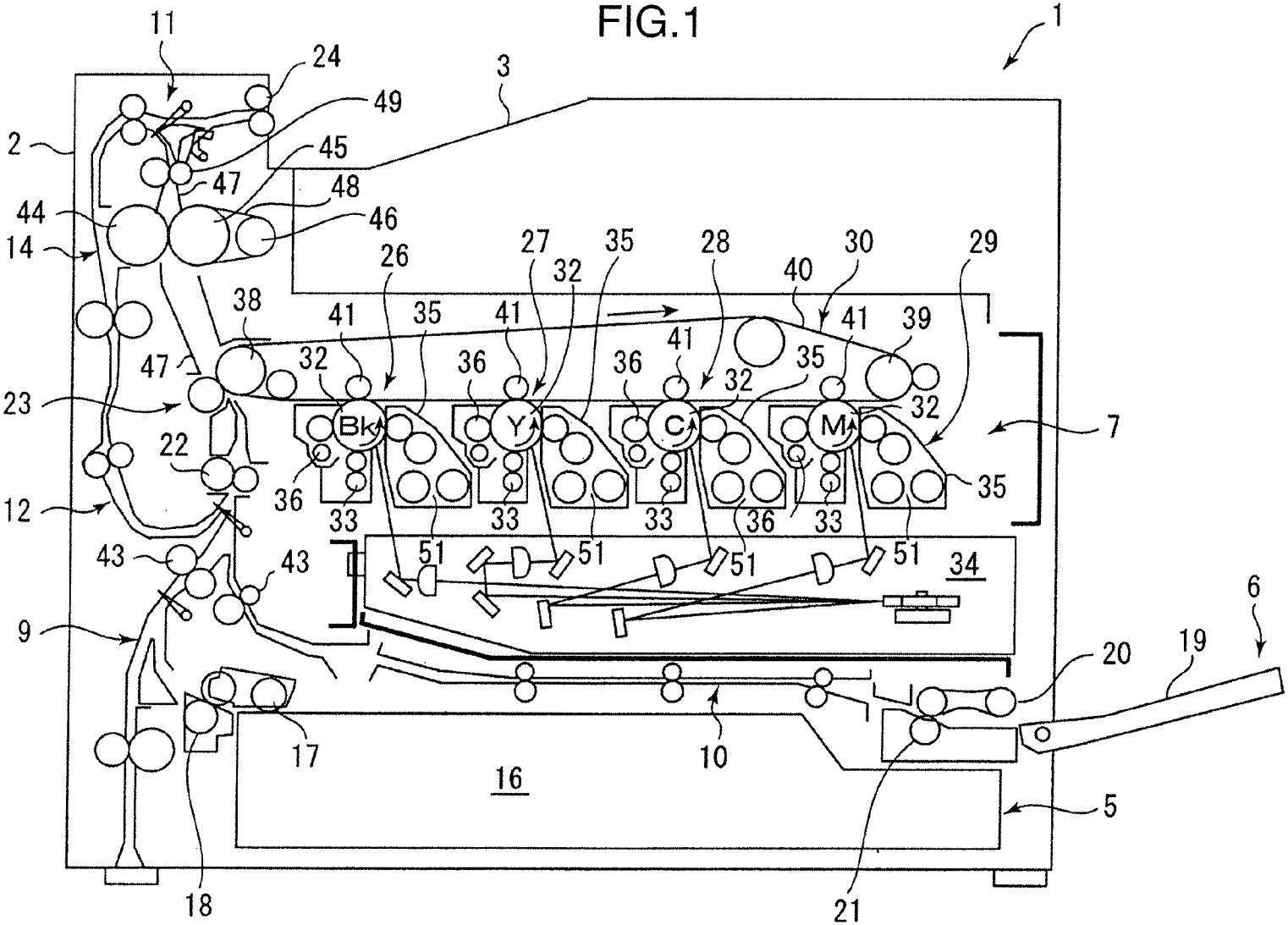
FIG. 1 is a schematic drawing showing a configuration of an image forming apparatus with a fixing unit.

FIG. 1 is a schematic drawing showing a configuration of the image forming apparatus with the fixing unit. The image forming apparatus shown in FIG. 1 is a tandem type color printer. Principles according to the present embodiment may be applied to a printer, a copying machine, a facsimile apparatus or a composite machine with their functions or another apparatus configured to carry out printing by transferring a toner image to a surface of a print medium such as a printing sheet on the basis of image information input from an external source.

The image forming apparatus 1 comprises a square box-shaped housing 2. A color image is formed on a sheet inside the housing 2. A discharge port 3 is provided on an upper surface of the housing 2. A sheet on which a color image is printed is discharged to the discharge port 3.

The housing 2 accommodates a supply cassette 5 configured to supply a sheet and an image forming unit 7. Furthermore, a stack tray 6 configured to supply a sheet to a manual feed system is installed on the housing 2. The stack tray 6 is disposed above the supply cassette 5. The image forming unit 7 above the stack tray 6 forms an image on a sheet on the basis of image data such as a text character, a picture or the like, which may be sent from an external source to the image forming apparatus 1.

A first conveyance path 9 is defined in a left portion of the housing 2 shown in FIG. 1. A sheet sent from the supply cassette 5 is conveyed to the image forming unit 7 via the first conveyance path 9. A second conveyance path 10 is defined above the supply cassette 5. A sheet fed from the stack tray 6 is moved from right to left via the second conveyance path 10 in the housing 2 to arrive at the image forming unit 7. A fixing unit 14 configured to carry out a fixing process to which a sheet after the image forming process carried out by the image forming unit 7 is subjected and a third conveyance path 11 configured to convey the sheet after the fixing process to the discharge port 3 are provided in an upper left portion inside the housing 2.

The supply cassette 5 is configured to be withdrawn to an exterior of the housing 2 (to the right side in FIG. 1, for example). A user may pull out the supply cassette 5 to replenish a sheet. The supply cassette 5 comprises an accommodating section 16. The user may accommodate, selectively, various sizes of sheets in the accommodating section 16. The sheets accommodated in the accommodating section 16 are one by one fed out toward the first conveyance path 9 by a feed roller 17 and a separation roller 18.

The stack tray 6 is configured to vertically rotate between a closed position where the stack tray 6 becomes flush with respect to an outer surface of the housing 2 and an open position (as shown in FIG. 1) where the stack tray 6 projects from the outer surface of the housing 2. A user may put a sheet one by one on a manual feeder 19 of the stack tray 6. Alternatively, the user may put a stack of sheets on the manual feeder 19. The sheet on the manual feeder 19 is fed one by one toward the second conveyance path 10 by a pickup roller 20 and a separation roller 21.

The first conveyance path 9 and the second conveyance path 10 converge before a registration roller 22. The registration roller 22 temporarily halts a sheet, and then carries out skew adjustment and timing adjustment for the sheet. After the skew adjustment and the timing adjustment, the registration roller 22 sends the sheet to a secondary transfer unit 23. A full-color toner image on an intermediate transfer belt 40 is secondarily transferred to the sheet supplied to the secondary transfer unit 23. After the secondary transfer, the sheet is supplied to the fixing unit 14. The fixing unit 14 fixes the toner image onto the sheet. Optionally, after the toner image is fixed on one surface of the sheet, the secondary transfer unit 23 may also form a new full-color toner image on another surface of the sheet (double-side printing). In a case of the double-side printing, after the toner image is fixed on one surface of the sheet, the sheet is sent to a fourth conveyance path 12, so that the sheet is inverted. A new toner image formed on another surface by the secondary transfer unit 23 is fixed by the fixing unit 14. Subsequently, the sheet passes along the third conveyance path 11, and then is delivered to the discharge port 3 by a discharge roller 24.

The image forming unit 7 includes four image forming units 26 to 29 which form black (Bk), yellow (Y), cyan (C) and magenta (M) toner images, respectively. The image forming unit 7 also comprises an intermediate transfer unit 30. The intermediate transfer unit 30 superimposes and holds the toner images formed by these image forming units 26 to 29.

Each of the image forming units 26 to 29 comprises a photosensitive drum 32 and a charging unit 33 facing a circumferential surface of the photosensitive drum 32. Each of the image forming units 26 to 29 comprises a laser scanning unit 34 configured to emit a laser beam onto the circumferential surface of the photosensitive drum 32 in accordance with image data such as a text character, a picture or the like, which is sent from an external source to the image forming apparatus 1. The laser beam from the laser scanning unit 34 is irradiated onto the circumferential surfaces of the photosensitive drum 32 at a downstream position of the charging unit 33. Each of the image forming units 26 to 29 also comprises a developing unit 35 facing the circumferential surface of the photosensitive drum 32. The developing unit 35 supplies toner to the circumferential surface of the photosensitive drum 32 holding an electrostatic latent image formed by irradiating the laser beam, thereby forming a toner image. The toner image formed on the circumferential surface of the photosensitive drum 32 is transferred to the intermediate transfer unit 30 (primary transfer). Each of the image forming units 26 to 29 also comprises a cleaning unit 36 facing the circumferential surface of the photosensitive drum 32. The cleaning unit 36 wipes the circumferential surface of the photosensitive drum 32 after the primary transfer.

The photosensitive drums 32 of the image forming units 26 to 29 shown in FIG. 1 are rotated in counter-clockwise direction by a drive motor (not shown), respectively. Black toner, yellow toner, cyan toner and magenta toner are accommodated inside toner boxes 51 of the developer units 35 of the image forming units 26 to 29, respectively.

The intermediate transfer unit 30 comprises a rear roller (drive roller) 38 in the vicinity of the image forming unit 26, a front roller (idle roller) 39 in the vicinity of the image forming unit 29 and an intermediate transfer belt 40 extending between the rear roller 38 and the front roller 39. The intermediate transfer unit 30 also comprises four transfer rollers 41 configured to press the intermediate transfer belt 40 against the photosensitive drums 32 of the respective image forming units 26 to 29. The transfer roller 41 presses the intermediate transfer belt 40 against the circumferential surface of the photosensitive drum 32 holding a toner image formed by the developing unit 35, so that the transfer roller 41 transfers the toner image to the intermediate transfer belt 40 (primary transfer).

As a result of the toner image transfer to the intermediate transfer belt 40, toner images formed with black toner, yellow toner, cyan toner and magenta toner are mutually superimposed on the intermediate transfer belt 40 into a full-color toner image.

The first conveyance path 9 extends toward the intermediate transfer unit 30. A sheet conveyed from the supply cassette 5 arrives at the intermediate transfer unit 30 via the first conveyance path 9. Conveyance rollers 43 for conveying a sheet are appropriately disposed along the first conveyance path 9. Furthermore, the registration roller 22 before the intermediate transfer unit 30 adjusts supply timing of the sheet passing along the first conveyance path 9 in synchronization with the image forming operation of the image forming unit 7.

The fixing unit 14 applies heat and pressure to a sheet. Consequently, an unfixed toner image just after the secondary transfer is fixed onto the sheet. The fixing unit 14 comprises a fixing roller 45 rotatably supported on the housing 2, a pressurization roller 44 configured to press against the fixing roller 45, a heat roller 46 adjacent to the fixing roller 45, and a heat belt 48 wound around the heat roller 46 and the fixing roller 45. In the present embodiment, the fixing roller 45 and the heat belt 48 are exemplified as a first element. Furthermore, the pressurization roller 44 is exemplified as a second element.

A conveyance roller 49 is provided after the fixing unit 14. A conveyance path 47 extending toward the conveyance roller 49 from the secondary transfer unit 23 is defined inside the housing 2. A sheet conveyed via the intermediate transfer unit 30 passes along the conveyance path 47 to be introduced into a nip defined between the pressurization roller 44 and the fixing roller 45/heat belt 48. The toner image is fixed to the sheet in the nip. The sheet passing the nip between the pressurization roller 44 and the fixing roller 45 via the conveyance path 47 is then guided to the third conveyance path 11.

The conveyance roller 49 conveys the sheet to the third conveyance path 11. The third conveyance path 11 guides to the discharge port 3 the sheet subjected to the fixing process by the fixing unit 14. Furthermore, the discharge roller 24 at an exit of the third conveyance path 11 discharges the sheet to the discharge port 3.

(Fixing Unit)

Figure 2C:
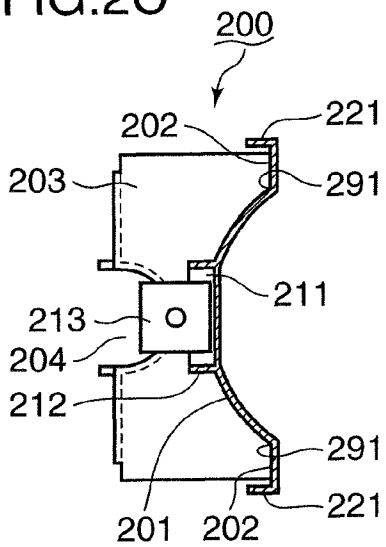
FIG. 2C is a cross-sectional view of the platform along a line A-A shown in FIG. 2A.
Figure 2A:
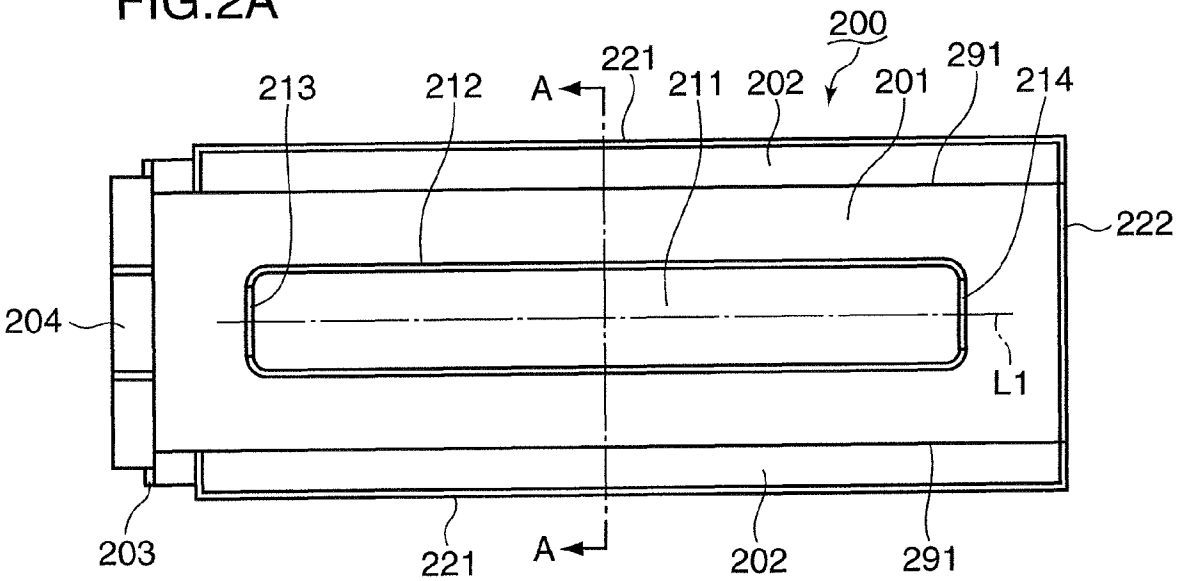
FIG. 2A is a plan view of a platform used in an IH coil unit of the fixing unit of the image forming apparatus shown in FIG. 1.
Figure 2B:
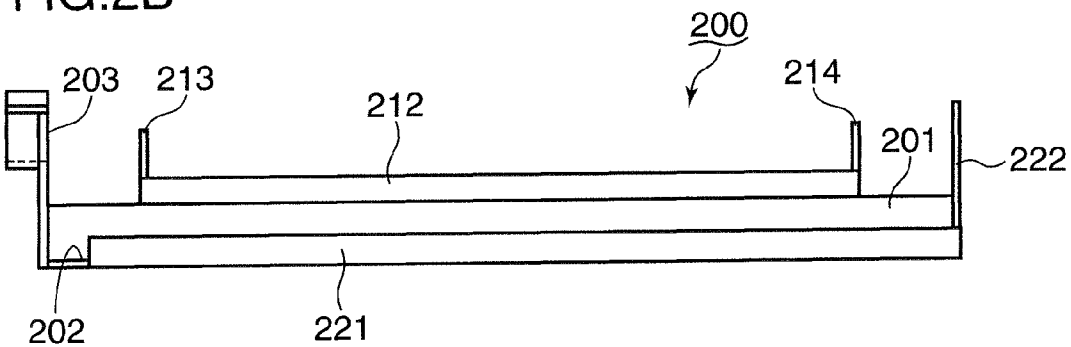
FIG. 2B is a side view of the platform shown in FIG. 2A.

FIG. 2A is a plan view of a platform used in an IH coil unit of the fixing unit 14. FIG. 2B is a side view of the platform. FIG. 2C is a cross-sectional view of the platform along a line A-A shown in FIG. 2A.

The platform 200 shown in FIGS. 2A to 2C supports various components to be used in the IH coil unit. The platform 200 includes a substantially rectangular coil supporting section 201 (see FIG. 2A). The coil supporting section 201 supports a coil configured to generate a magnetic field for induction-heating the fixing roller 45 and/or the heat belt 48. The coil supporting section 201 bulges upward and outward to form a curved surface (see FIG. 2C). A positioning wall 212 defining a substantially rectangular region 211 is formed on an upper end of the coil supporting section 201. The positioning wall 212 upwardly projects from an entire inner edge of the coil supporting section 201. The positioning wall 212 contacts an inner edge of a looped coil surface (described below) to position the coil surface. The positioning wall 212 includes a first upright wall 213 and a second upright wall 214 opposite the first upright wall 213. The first upright wall 213 and the second upright wall 214, which are disposed on a longitudinal axis L1 of the region 211, project significantly further upward compared to other portions of the positioning wall 212 (see FIG. 2B). The first upright wall 213 and the second upright wall 214, which are surrounded with the coil surface formed with the coil fixed on the coil supporting section 201, projects from an opening region of which contour is defined by the inner edge of the coil surface.

A core supporting section 202 is formed adjacent to an outer edge 291 of the coil supporting section 201 in parallel to the longitudinal axis L1 of the region 211. A side core (described below) is placed and fixed on a flat upper surface of the core supporting section 202. In the present embodiment, the side core is exemplified as a magnetic member. A positioning wall 221 is formed along an outer edge of the core supporting section 202. The positioning wall 221 projecting upward with respect to the core supporting section 202 is configured to position the side core on the core supporting section 202. The positioning wall 221 forms a rectangular region surrounding the core supporting section 202. The positioning wall 221 includes a third upright wall 222 facing the second upright wall 214. The coil supporting section 201 extends between the second upright wall 214 and the third upright wall 222. The second upright wall 214 is adjacent to the inner edge of the coil surface on the coil supporting section 201 while the third upright wall 222 is adjacent to an outer edge of the coil surface on the coil supporting section 201.

A left end of the coil supporting section 201 extends leftward beyond the positioning wall 221. A fourth upright wall 203 is formed adjacent to the left end of the coil supporting section 201. A substantially U-shaped notch section 204 is formed in the fourth upright wall 203. A power line (not shown) extends to the coil fixed on the coil supporting section 201 through the notch section 204, which extends downward from an upper edge of the fourth upright wall 203. Electrical power is supplied to the coil via the power line to generate a magnetic field. The platform 200 shown in FIGS. 2A to 2C is integrally molded from a nonconductive heat-resistant resin (for example, PPS, PET, LCP). The coil surface on the platform 200 shown in FIGS. 2A to 2C may be, for example, 360 mm in longitudinal inner diameter. A distance between the first upright wall 213 and the second upright wall 214 may be approximately 350 mm, for example. The center core along the opening region defined by the inner edge of the coil surface may be, for example, 340 mm in length.

Figure 3A:
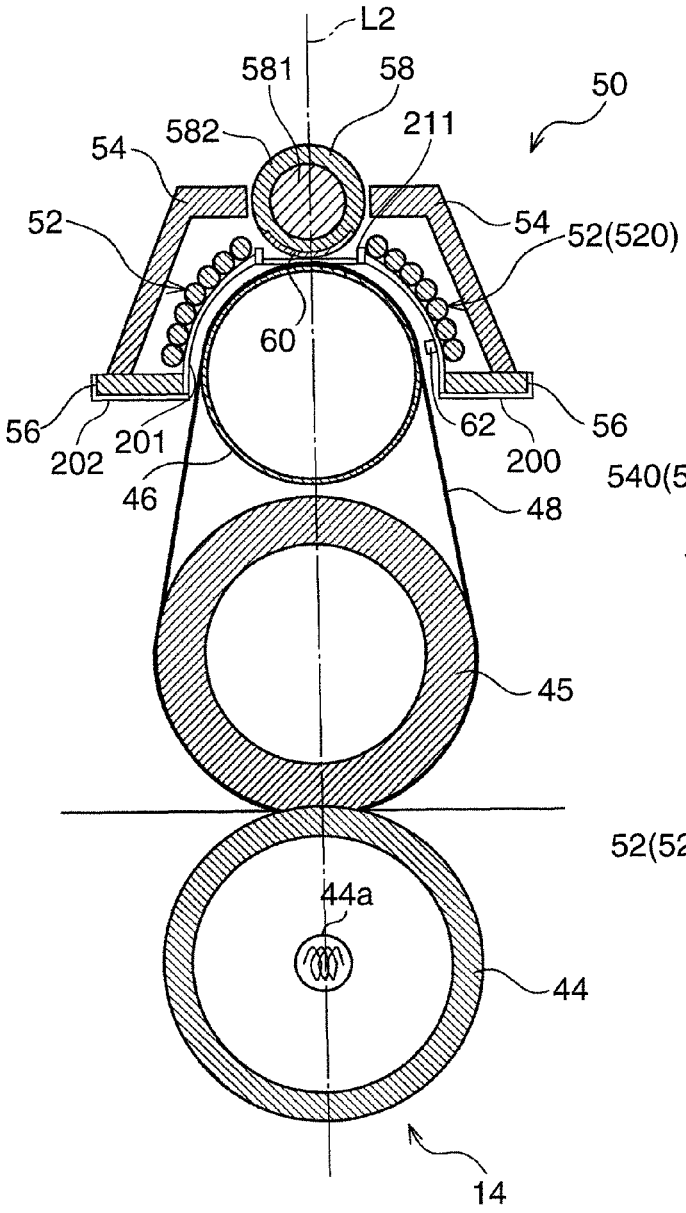
FIG. 3A is a cross-sectional view of the fixing unit shown in FIG. 1.
Figure 3B:
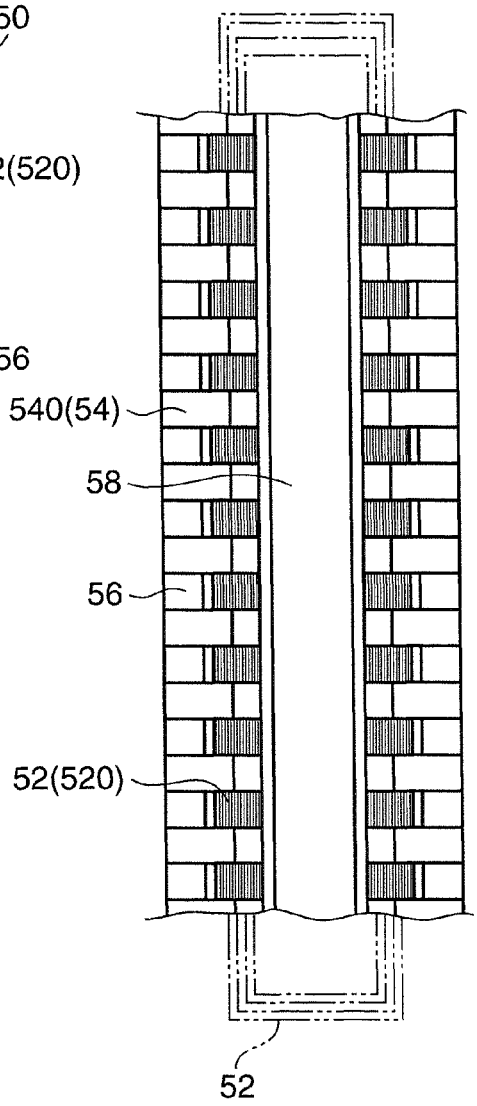
FIG. 3B is a plan view of the fixing unit shown in FIG. 3A.

FIG. 3A is a cross-sectional view of the fixing unit 14 shown in FIG. 1. FIG. 3B is a plan view of the fixing unit 14 shown in FIG. 3A. A term "paper passage width" used in the description of the fixing unit 14 means a width dimension of a sheet passing inside the image forming apparatus 1 shown in FIG. 1, (the term "paper passage width" generally means a dimension of a sheet in a direction perpendicular to a conveyance direction of the sheet inside the image forming apparatus 1). Typically, the paper passage width is determined in accordance with industrial standards (ISO, JIS, DIN or the like). Moreover, a term "maximum paper passage width" used in the following description means a width dimension of a largest sheet which the image forming apparatus 1 allows to pass therein. In the case of the image forming apparatus 1 described in the context of FIG. 1, this term means a width of a largest sheet to be accommodated/conveyed in/from the supply cassette 5 or a width of a largest sheet to be conveyed from the stack tray 6. Furthermore, the term "minimum paper passage width" used in the following description means a width dimension of a smallest sheet which the image forming apparatus 1 allow to pass through therein. In the case of the image forming apparatus 1 described in the context of FIG. 1, this term means a width of a smallest sheet to be conveyed from the supply cassette 5 or the stack tray 6.

As described above, the fixing unit 14 comprises the pressurization roller 44, the fixing roller 45, the heat roller 46 and the heat belt 48. A surface layer of the fixing roller 45 may be an elastic silicone sponge layer, so that a flat nip is formed between the heat belt 48 and the fixing roller 45.

The heat belt 48 comprises a nickel electroformed base material which may be more than about 30 μm and less than about 50 μm in thickness, a silicone rubber layer laminated on the nickel electroformed base material and a separating layer (for example, a PFA layer) formed on the silicone rubber layer. The cylindrical heat roller 46 may be 30 mm in outer diameter, for example. The heat roller 46 comprises a cylindrical iron base material and a separating layer (for example, a PFA layer) which may be more than 0.2 mm and less than 1.0 mm in thickness. The separating layer is formed on an outer circumferential surface of the iron base material. The columnar fixing roller 45, for example, comprises a metal (stainless steel) core roller which may be 45 mm in outer diameter and a sponge (silicone rubber) layer which may be more than 5 mm and less than 10 mm in thickness. The sponge layer covers an outer circumferential surface of the metal core roller. The columnar pressurization roller 44 may be 50 mm in outer diameter, for example. The pressurization roller 44 comprises a metal core roller made of stainless steel, a sponge (silicone rubber) layer which may be more than 2 mm and less than 5 mm in thickness and a separating layer (for example, a PFA layer). The sponge layer covers an outer circumferential surface of the metal core roller.

The metal core of the pressurization roller 44 may be made from iron, aluminum or the like, for example. A silicone rubber layer may be formed on the core material. The pressurization roller may additionally include a fluorine resin layer formed on a surface of the silicone rubber layer. Further, the pressurization roller 44 may house a halogen heater 44*a*, for example.

The fixing unit 14 also comprises an IH coil unit 50. The IH coil unit 50 outside the heat roller 46 and the heat belt 48 is assembled on the platform 200 described in the context of FIGS. 2A to 2C. The IH coil unit 50 comprises the induction-heating coil 52 to form the coil surface 520 on the coil supporting section 201 of the platform 200, a pair of side cores 56 on the core supporting section 202 of the platform 200, a pair of arch cores 54 surrounding the heat belt 48, the side cores 56 and the coil surface 520, and a center core 58 disposed along the region 211 of the platform 200 (see FIG. 2A). In the present embodiment, the paired arch cores 54 as well as the paired side cores 56 are exemplified as a magnetic member.

In the present embodiment, an arcuate portion of the heat roller 46 and the heat belt 48 is an object region to be induction-heated. The induction-heating coil 52 on the coil supporting section 201 of the platform 200 includes insulated and twisted enamel wires. The induction-heating coil 52, to which the electrical power is supplied, generates a magnetic field/a magnetic flux to induction-heat the object region.

The coil supporting section 201 is configured to follow an arcuate outer surface of the heat roller 46 and/or the heat belt 48. The induction-heating coil 52 is wound around the coil supporting section 201, so that the induction-heating coil 52 is laid along the curved coil supporting section 201 to form the coil surface 520 arcuate in cross-section. The induction-heating coil 52 forms a loop on the heat roller 46 in plan view. Substantially an upper half of the heat roller 46 shown in FIG. 3A is surrounded by the induction-heating coil 52. The induction-heating coil 52 disposed to follow the coil supporting section 201 forms the looped coil surface 520 on the coil supporting section 201.

The center core 58 on the straight line L2 connecting the rotational center axes of the pressurization roller 44, the fixing roller 45 and the heat roller 46 is disposed near the heat roller 46. The center core 58 is disposed along the region 211 of the platform 200 (see FIG. 2A). Alternatively, the center core 58 may be placed at another suitable position along the open region, of which contour is defined by the inner edge of the coil surface 520.

The paired arch cores 54 are provided in left/right symmetry with respect to the center core 58. Similarly, the paired side cores 56 are provided in left/right symmetry with respect to the center core 58. The arch core 54 may be a ferrite core molded to have an arcuate cross-section. The arch core 54 may be longer than the coil surface 520. The side core 56 may be a ferrite block. The side core 56 may be connected to one end of the arch core 54 (a lower end in FIG. 3A). The arch cores 54 and the side cores 56 partially and externally surround the coil surface 520. The coil surface 520 becomes surrounded by an outer surface of the heat belt 48, the side cores 56, the arch cores 54 and the center core 58.

The arch core 54 comprises arch core pieces 540 at several locations at intervals so that the arch core pieces 540 are longitudinally aligned along the heat roller 46, for example. The arch core piece 540 may be a substantially L-shaped ferrite member which may be approximately 10 mm in width, for example. Denser arrangement of the arch core pieces 540 may enhance heating-efficiency. On the other hand, coarser arrangement of the arch core pieces 540 may contribute to reduction in manufacturing cost and weight of the fixing unit 14. Consequently, it is preferable to adjust the arrangement density of the arch core pieces 540 appropriately on the basis of the heating efficiency, the reduction in the manufacturing cost and/or the weight. The arch core pieces 540 shown in FIG. 3B are arranged at regular intervals. Alternatively, the arrangement density of the arch core pieces 540 may be lowered in the vicinity of the longitudinally central position of the center core 58 while the arrangement density of the arch core pieces 540 may be raised near end portions of the center core 58. The interval between the arch core pieces 540 may be varied from ⅓ to ½ of their widths.

The side core 56 on the core supporting section 202 of the platform 200 may also include ferrite plates which may be more than 30 mm and less than 60 mm in length, respectively. The ferrite plates of the side core 56 may be continuously aligned, for example. As shown in FIG. 2A, the entire side core 56 is substantially as long as the core surface 520. The arch core 54 and the side core 56 may be deployed in accordance with distribution of the magnetic flux density (magnetic field strength) generated by the induction-heating coil 52, for example. In a portion where the arch core piece 540 is not exist, the side core 56 supplement magnetic field convergence effect to make the magnetic flux density distribution (temperature differential) longitudinally uniform (in a direction along the straight line L1 shown in FIG. 2A). The arch core 54 may be supported with a core holder (not shown) made of resin, for example. Preferably, the core holder is molded from heat-resistant resin (for example, PPS, PET, LCP). The arch cores 54 and the side cores 56, in combination with magnetic tubes (described hereinafter) of the center core 58, surround at least partially the fixing roller 45, the heat belt 48 and the coil surface 520.

The fixing unit 14 shown in FIG. 3A comprises a thermistor 62 configured to measure temperature of the heat belt 48 in a noncontact manner. Preferably, the thermistor 62 outside the heat belt 48 is positioned where the induction-heating is likely to be more effective. The temperature of the heat belt 48 may also be measured with a thermostat instead of the thermistor. Alternatively, the thermistor 62 or the thermostat may also be disposed inside the heat roller 46. Usage of the temperature measuring element such as the thermistor or the thermostat improves safety during abnormal increase in the temperature.

Like the heat roller 46, the center core 58 is long enough to correspond to the maximum paper passage width of the sheet. The center core 58 includes a conductive shaft 581 and a magnetic tube 582 attached to the conductive shaft 581. Although not shown in FIG. 3A and FIG. 3B, a conductive shaft 581 is coupled to a drive mechanism configured to rotate the center core 58 about its rotational center axis longitudinally extending. The center core 58 extending substantially in parallel with the rotational center axis of the heat roller 46 is disposed adjacent to an upper surface of the heat roller 46/the heat belt 48 and adjacent to the left and right inner edges of the coil surface 520.

A first magnetism shielding plate 60 is attached to an outer circumferential surface of the center core 58. The thinner first magnetism shielding plate 60 arcing along an outer circumferential surface of the center core 58 rotates together with the center core 58 to switch a path of the magnetic field (magnetic path) generated by the induction-heating coil 52.

Preferably, the first magnetism shielding plate 60 is made from a non-magnetic and well-conductive material (for example, oxygen-free copper). A path of the magnetic field perpendicular to a surface of the first magnetism shielding plate 60 generates an induction current. This induction current results in an inverse magnetic field to cancel out an inter-linkage magnetic flux (a perpendicularly penetrating magnetic field). As a result, the first magnetism shielding plate 60 may shield the magnetic field. A first magnetism shielding plate 60 made from a well-conductive material is less likely to generate Joule heating due to the induction current, so that the magnetic field may be effectively shielded. A first magnetism shielding plate 60 made from a material with lower intrinsic resistance and/or a thicker first magnetism shielding plate 60 is more conductive. Preferably, the first magnetism shielding plate 60 may be thicker than 0.5 mm. In the present embodiment, the first magnetism shielding plate 60 which is 1 mm in thick is used.

(Center Core)

Figure 4:
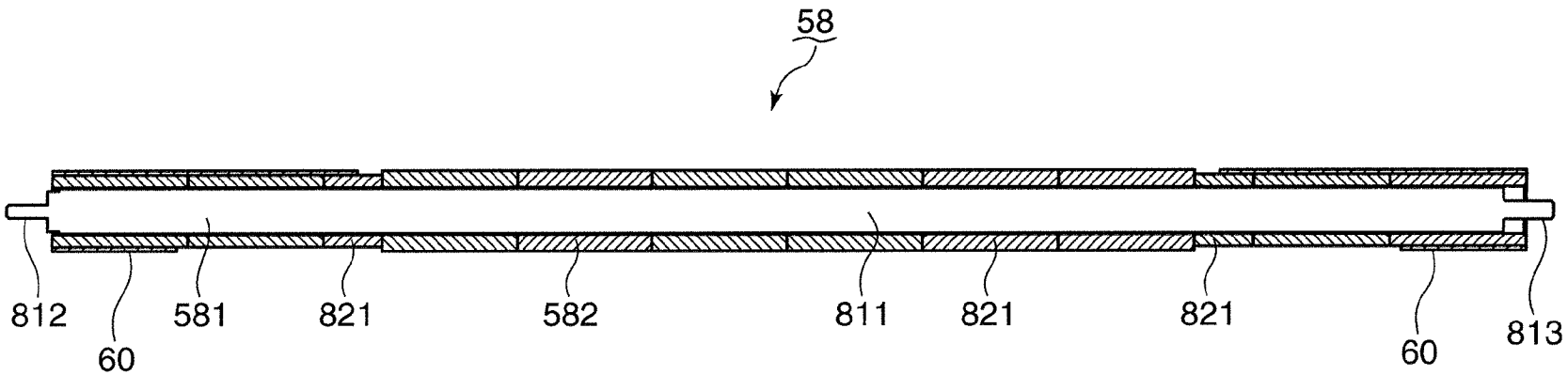
FIG. 4 shows a longitudinal cross-section of a center core of the fixing unit shown in FIG. 3A.

FIG. 4 shows a longitudinal cross-section of the center core 58. The center core 58 comprises a columnar conductive shaft 581 and a cylindrical magnetic tube 582 covering the conductive shaft 581. The magnetic tube 582 is bonded to the conductive shaft 581 with a silicone adhesive, for example. The cylindrical magnetic tube 582 may be more than 14 mm and less than 20 mm in outer diameter, for example. The conductive shaft 581 includes a trunk 811 configured to fit into the cylindrical magnetic tube 582, a first journal 812 extending from a left end of the trunk 811 and a second journal 813 extending from a right end of the trunk 811. The first journal 812 and the second journal 813 may be thinner than the trunk 811. The first and second journals 812 and 813, which are coaxial with the trunk 811, project from the magnetic tube 582. Preferably, the conductive shaft 581 is made from non-magnetic stainless steel. The conductive shaft 581 made of the stainless steel is less likely to cause deformation of the center core 58.

The magnetic tube 582 includes substantially cylindrical magnetic tubular pieces 821. The magnetic tubular pieces 821 are molded from ferrite, for example. The magnetic tubular pieces 821 are provided consecutively along the conductive shaft 581. The outer diameter of the magnetic tubular pieces 821 at a longitudinally central position of the conductive shaft 581 is longer than that at left and right ends of the trunk 811 of the conductive shaft 581. The first magnetism shielding plate 60 partially covers outer circumferential surface of the thinner magnetic tubular pieces 821, so as to fill a step between the magnetic tubular piece 821 at the center of the conductive shaft 581 and the magnetic tubular pieces 821 at the left and right ends of the conductive shaft 581.

Figure 5B:
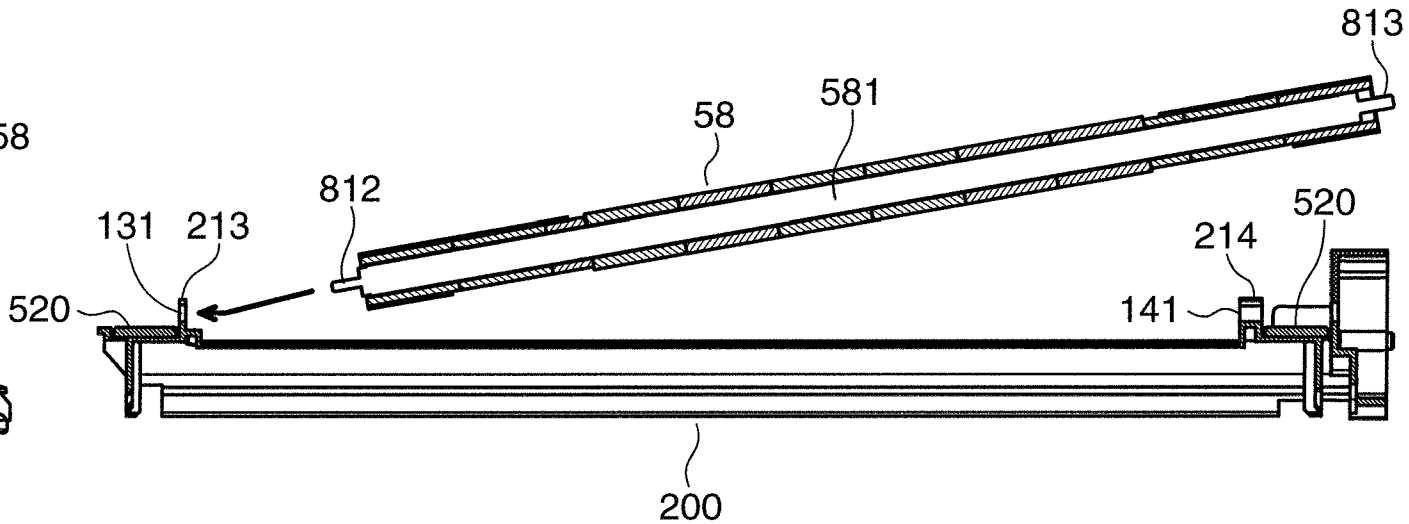
FIG. 5B shows a longitudinal cross-section of the platform and the center core shown in FIG. 5A.
Figure 5A:
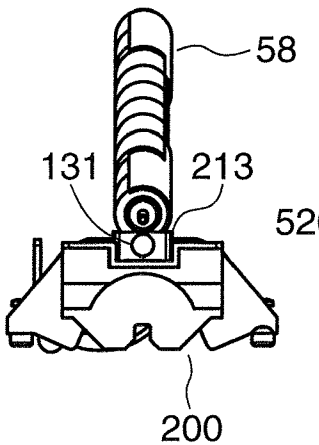
FIG. 5A is a diagram showing a front view of a first upright wall on which a first journal of the center core shown in FIG. 4 is mounted.

FIG. 5A is a front view of the first upright wall 213 on which the first journal 812 of the center core 58 is mounted. FIG. 5B shows a longitudinal cross-section of the platform 200 and the center core 58 shown in FIG. 5A. FIG. 5B shows a coil surface 520 adjacent to the first upright wall 213 and the second upright wall 214.

The first upright wall 213 includes a first opening 131. The second upright wall 214 includes a second opening 141. The first opening 131 and the second opening 141 extend through the first upright wall 213 and the second upright wall 214, respectively. Outer diameters of the first journal 812 and the second journal 813 are shorter than diameters of the first opening 131 and the second opening 141. As shown in FIGS. 5A and 5B, the first journal 812 is inserted into the first opening 131 in the first upright wall 213 at first. As described above, the diameter of the first opening 131 is sufficiently longer than the outer diameter of the first journal 812. Consequently, as shown in FIGS. 5A and 5B, a user may insert the first journal 812 into the first opening 131 with tilting the center core 58. Thereupon, the second journal 813 is inserted into the second opening 141. Consequently, the trunk 811 of the conductive shaft 581 and the magnetic tube 582 configured to cover the trunk 811 are aligned along the opening region of the looped coil surface 520 (the space surrounded by the induction-heating coil 52).

Figure 6A:
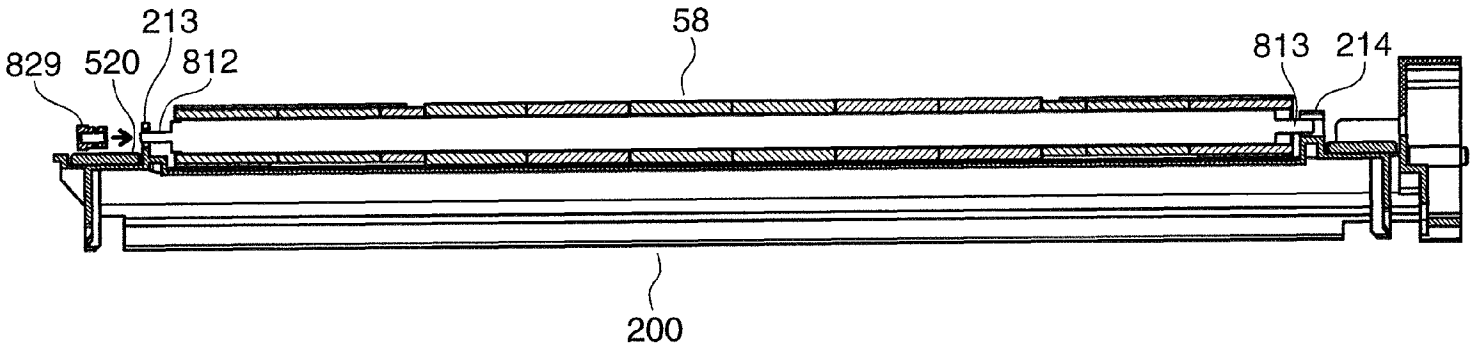
FIG. 6A shows a longitudinal cross-section of the platform and the center core after assembling the center core as shown in FIGS. 5A and 5B.
Figure 6B:
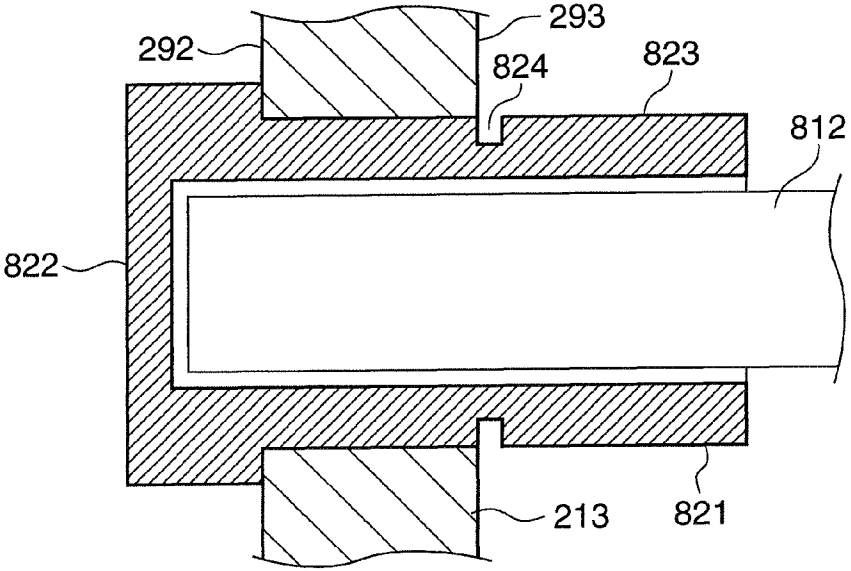
FIG. 6B is an enlarged view of a structure around the first upright wall of the platform shown in FIG. 6A.

FIG. 6A shows a longitudinal cross-section of the platform 200 and the center core 58, and FIG. 6B is an enlarged diagram around the first upright wall 213 of the platform. FIGS. 6A and 6B show an assembly step to be carried out subsequently after the center core assembly step shown in FIGS. 5A and 5B.

As shown in FIGS. 6A and 6B, the first journal 812 and the second journal 813 are mounted on the first upright wall 213 and the second upright wall 214, respectively, and then a first nonconductive cap 829 is attached to the first journal 812. The substantially cylindrical first nonconductive cap 829 is inserted into the first opening 131 of the first upright wall 213 to cover a tip of the first journal 812. The first journal 812 rotates inside the first nonconductive cap 829 when the center core 58 rotates. Consequently, the first nonconductive cap 829 functions as a slide bearing. The first nonconductive cap 829 does not rotate with respect to the first upright wall 213. Alternatively, a projecting section may be formed in an inner wall portion defining the first opening 131 of the first upright wall 213. A groove section configured to engage with the projection section may be also formed in a trunk 823 of the first nonconductive cap 829, so that rotation of the first nonconductive cap 829 may be prevented by engagement between the projecting section and the groove section.

The first nonconductive cap 829 includes a bottom section 822 adjacent to an outer surface 292 of the first upright wall 213 and the trunk 823 thinner than the bottom section 822. As shown in FIG. 6A, the bottom section 822 is disposed near the coil surface 520. An annular groove 824 adjacent to an inner surface 293 of the first upright wall 213 is formed in an outer circumferential surface of the trunk 823. The first nonconductive cap 829 is preferably molded from a nonconductive material. The material used for the first nonconductive cap 829 may be, for example, a heat-resistant resin (such as PPS resin, fluorine resin or the like). The first nonconductive cap 829 completely covering the tip of the conductive first journal 812 achieves electrical insulation between the first journal 812 and the coil surface 520.

Figure 7B:
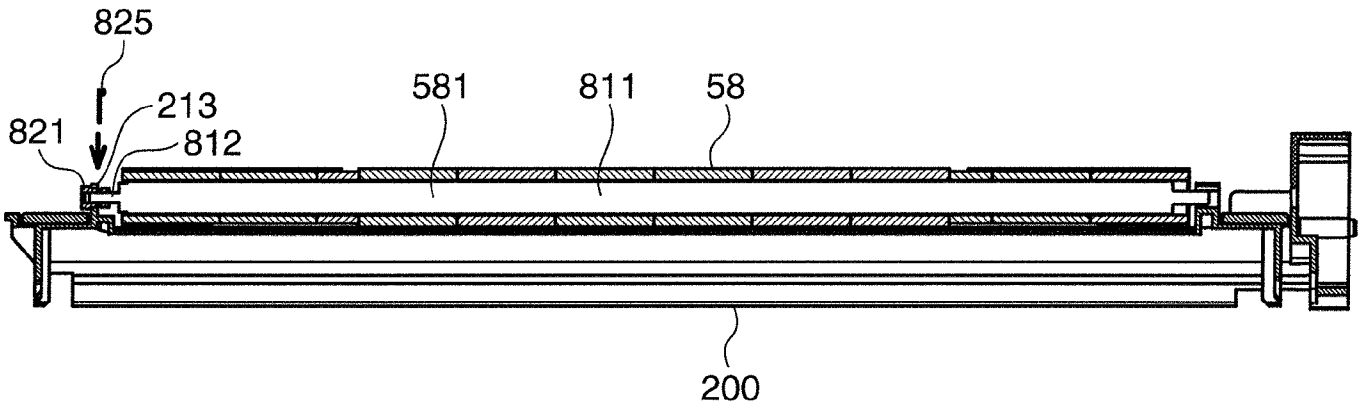
FIG. 7B shows a longitudinal cross-section of the platform and the center core shown in FIG. 7A.
Figure 7A:
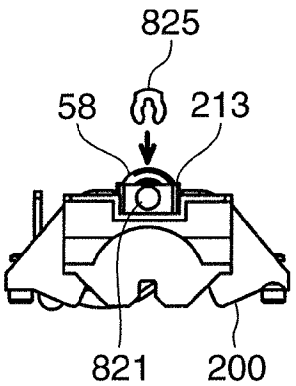
FIG. 7A is a front view of the first upright wall of the platform after the assembly step shown in FIGS. 6A and 6B.

FIG. 7A is a front view of the first upright wall 213. FIG. 7B shows a longitudinal cross-section of the platform 200 and the center core 58. FIGS. 7A and 7B show an assembly step to be carried out after the assembly step shown in FIGS. 6A and 6B.

After the first nonconductive cap 829 is attached to the first upright wall 213 and the first journal 812, a substantially C-shaped clamping plate 825 is engaged in the groove section 824 (see FIG. 6B) formed in the trunk 823 of the first nonconductive cap 829. The clamping plate 825 configured to clamp the first nonconductive cap 829 contacts the inner surface 293 of the first upright wall 213 (see FIG. 6B). Thus, the trunk 811 of the conductive shaft 581 is prevented from shifting toward the first upright wall 213.

Figure 8A:
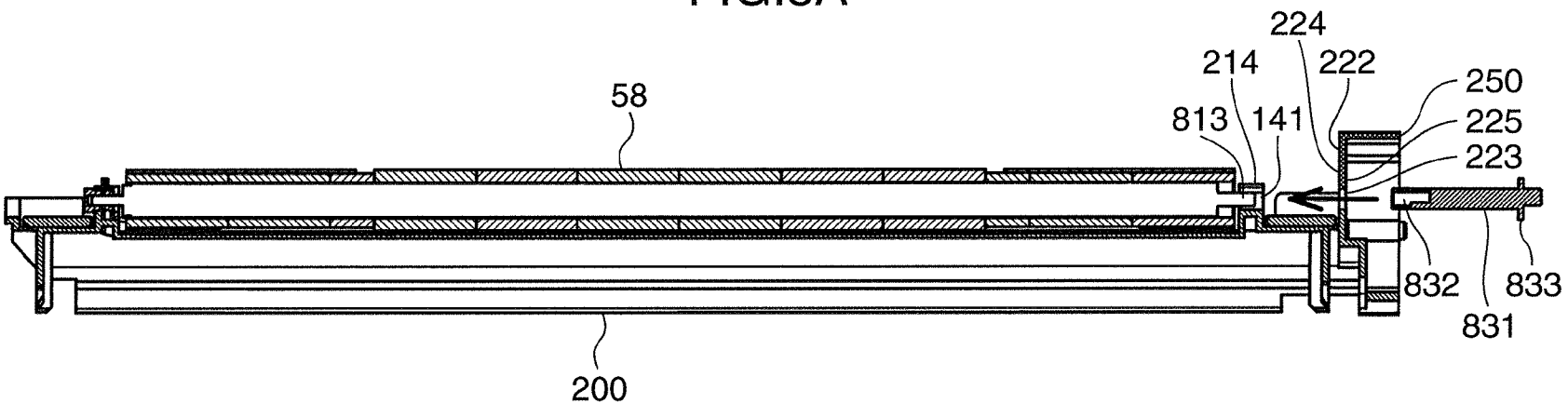
FIG. 8A shows a longitudinal cross-section of the platform and the center core after the assembly step shown in FIGS. 7A and 7B.
Figure 8B:
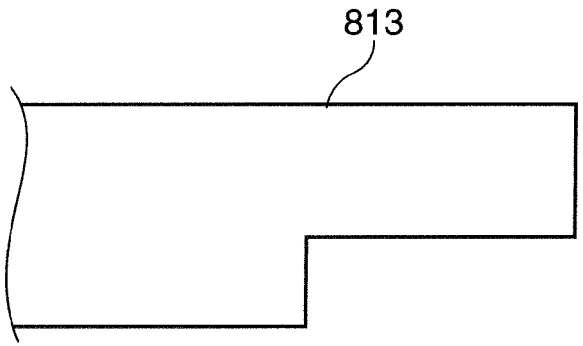
FIG. 8B is an enlarged view of a tip of the second journal shown in FIG. 8A.
Figure 8C:
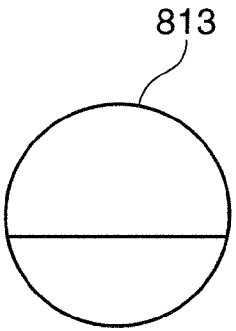
FIG. 8C is a front view of an end face of the second journal shown in FIG. 8A.

FIG. 8A shows a longitudinal cross-section of the platform 200 and the center core 58. FIG. 8B shows an enlarged view of a tip of the second journal 813. FIG. 8C is a front view of an end face of the second journal 813. FIGS. 8A to 8C show an assembly step to be carried out after the assembly step shown in FIGS. 7A and 7B.

The tip of the second journal 813 shown in FIGS. 8A to 8C is subjected to a D cut to partially remove the tip of the second journal 813. The D cut tip of the second journal 813 is exemplified as a first portion noncircular in cross-section. As shown in FIG. 8C, the end face of the second journal 813 forms a substantially D shape. A second nonconductive cap 831 is configured to be engaged and rotated with the second journal 813. Alternatively, the second nonconductive cap 831 may be fixed to the second journal 813 with an adhesive. Yet alternatively, a projecting section or groove section may be formed in the second journal 813. The second nonconductive cap 831 may includes a groove section or a projecting section configured to engage with the projecting section or the groove section of the second journal 813. The second nonconductive cap 831 and the second journal 813 may rotate together because of engagement between the projecting section/the groove section of the second journal 813 and the groove section/projecting section of the second nonconductive cap 831. Yet alternatively, the second journal 813 may also be shaped into any noncircular cross-section (for example, a square cross-section or a star-shaped cross-section). The second nonconductive cap 831 may include an internal space of which cross-section is complementary to the noncircular cross-section of the second journal 813. The second nonconductive cap 831 configured to engage with the second journal 813, so that the second nonconductive cap 831 rotates with the second journal 813 noncircular in cross-section.

As shown in FIG. 8A, the third upright wall 222 partially forms a gear housing 250. The third upright wall 222 includes a third opening 223 (through-hole). The third opening 223 is coaxial with the second opening 141 of the second upright wall 214.

In the assembly step shown in FIGS. 8A to 8C, the substantially columnar second nonconductive cap 831 is attached to the second journal 813. An internal space 832 complementary to the D-cut tip of the second journal 813 is formed in an end of the second nonconductive cap 831. A gear 833 is formed adjacent to a base end of the second nonconductive cap 831. In the present embodiment, the gear 833 is formed integrally with the second nonconductive cap 831. Alternatively, the gear 833 may be formed separately from the second nonconductive cap 831. The second nonconductive cap 831 is molded from a preferable nonconductive material. The material used for the second nonconductive cap 831 is, for example, a heat-resistant resin (such as PPS resin or fluorine resin). The second nonconductive cap 831 is inserted into the third opening 223 of the third upright wall 222 and the second opening 141 of the second upright wall 214 to cover the tip of the second journal 813. The third upright wall 222 includes a first surface 224 facing the second upright wall 214 and a second surface 225 opposite the first surface 224. The gear 833 abuts against the second surface 225.

Figure 9:
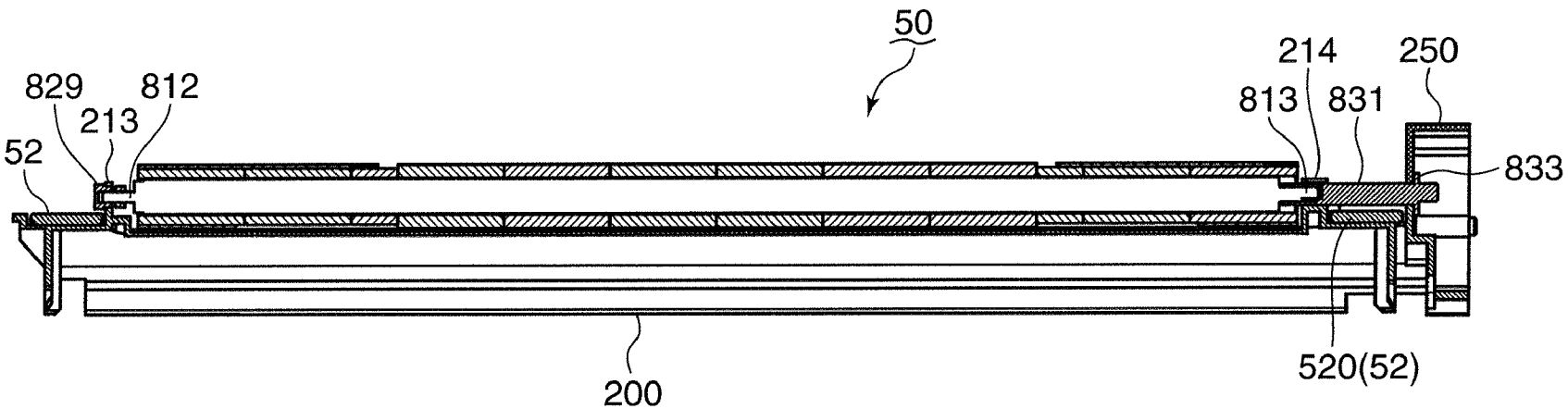
FIG. 9 shows the IH coil unit after attachment of a second nonconductive cap on the second journal through the steps shown in FIGS. 8A to 8C.

FIG. 9 shows the IH coil unit 50 after the second nonconductive cap 831 is attached to the second journal 813 through the assembly step shown in FIGS. 8A to 8C.

The gear 833 in the gear housing 250 transmits drive power generated by the drive mechanism to the second nonconductive cap 831 to be rotated. As the second nonconductive cap 831 is rotated, the center core 58 turns due to the connection between the tip portion of the second journal 813 in the internal space 832 and the second nonconductive cap 831.

The second nonconductive cap 831 bridges over the coil surface 520 between the second upright wall 214 and the third upright wall 222. The second upright wall 214 and the third upright wall 222 rotatably support the second nonconductive cap 831. As shown in FIG. 9, the coil surface 520 is surrounded by the platform 200 and the second nonconductive cap 831, which are made of nonconductive material, and therefore electrical insulation between the second journal 813 and the coil surface 520 is achieved. Furthermore, the first upright wall 213 and the second upright wall 214 support and separate the first journal 812, the first nonconductive cap 829, the second journal 813 and the second nonconductive cap 831, from the coil surface 520, so that the induction-heating coil 52 is less likely to be damaged by the rotation of the center core 58.

(Drive Mechanism)

Figure 10:
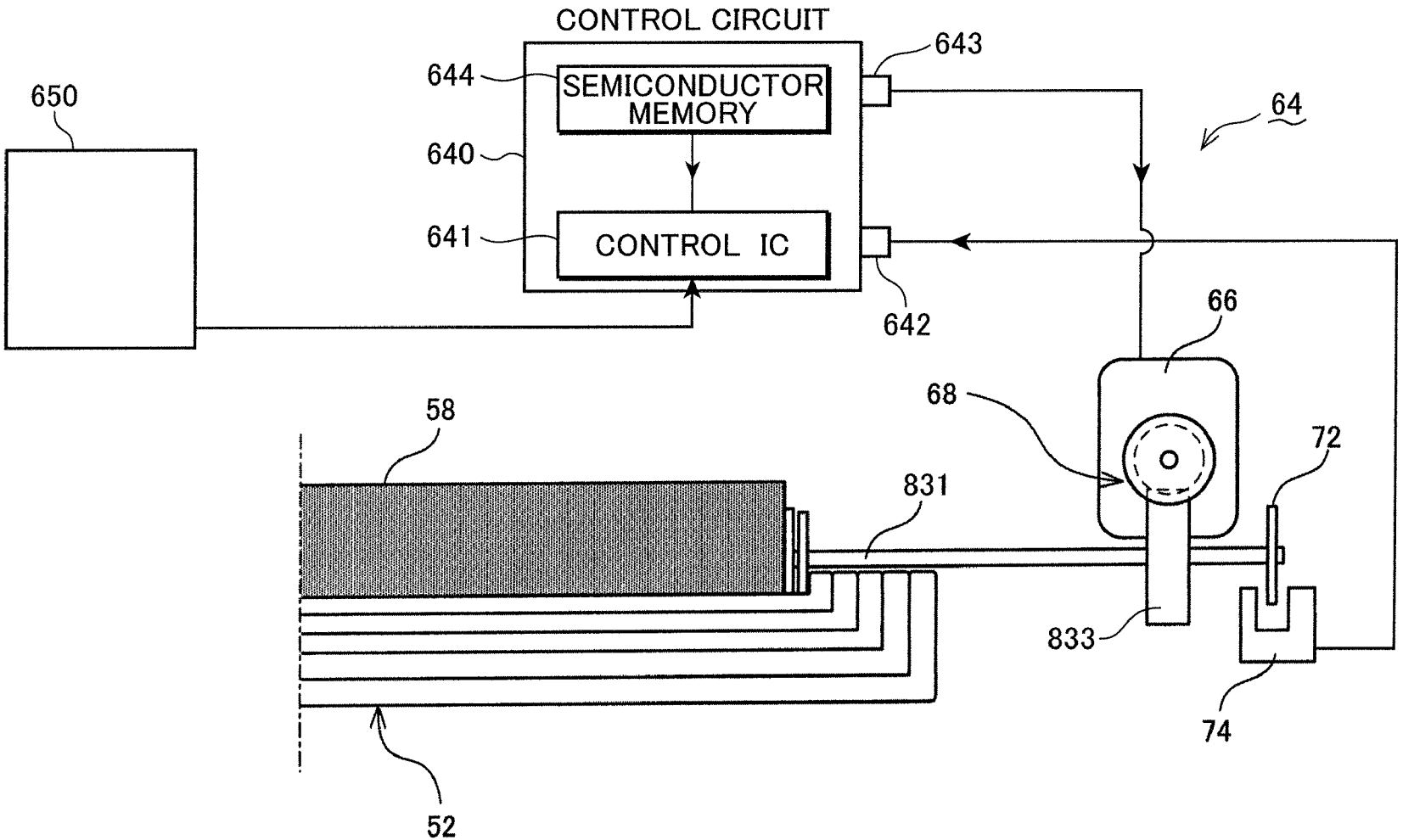
FIG. 10 schematically shows a configuration of a drive mechanism connected to the center core shown in FIG. 4.

FIG. 10 schematically shows a configuration of the drive mechanism 64 connected to the center core 58.

The drive mechanism 64 may be deployed inside the gear housing 250 of the platform 200 shown in FIG. 9, for example. The drive mechanism 64 rotates the center core 58 via the second nonconductive cap 831. The rotation of the center core 58 causes change in a position of the first magnetism shielding plate 60. The magnetic field or the magnetic path created by the electrical power supply to the induction-heating coil 52 is switched with the displacement of the first magnetism shielding plate 60.

The drive mechanism 64 comprises, for example, a stepping motor 66 inside the gear housing 250, and a decelerator 68 configured to decelerate a rotation speed of the stepping motor 66 in the gear housing 250. The gear 833 of the second nonconductive cap 831 coupled to the second journal 813 engages with the decelerator 68. The stepping motor 66 drives the second nonconductive cap 831 to cause the center core 58 to rotate. A worm gear, for instance, may be used as the decelerator 68. The drive mechanism 64 also comprises a slit disk 72 fixed to an end of the second nonconductive cap 831, and a photo-interrupter 74 configured to detect a rotation angle of the slit disk 72 (in other words, the rotation angle of the center core 58 (an amount of the rotational displacement from a reference position)).

The rotation angle of the center core 58 is controlled by means of a number of drive pulses applied to the stepping motor 66, for example. The drive mechanism 64 comprises a control circuit 640 configured to control the rotation of the stepping motor 66. The control circuit 640 comprises, for instance, a control IC 641, an input driver 642, an output driver 643, a semiconductor memory 644 and the like. A detection signal from the photo-interrupter 74 is input to the control IC 641 via the input driver 642. The control IC 641 determines a real-time rotation angle (position) of the center core 58 on the basis of the input signal. On the other hand, an information signal relating to an in-use sheet size is sent to the control IC 641 from an image formation control unit 650 which is provided in the image forming apparatus 1 shown in FIG. 1. After receiving the information signal from the image formation control unit 650, the control IC 641 reads out rotation angle information corresponding to the sheet size from the semiconductor memory (ROM) 644 to output, at regular intervals, the drive pulses so that the center core 58 rotates up to a target angle. The drive pulses are applied to the stepping motor 66 via the output driver 643. The stepping motor 66 operates in accordance with the drive pulses. If it is necessary to detect only the reference position during the control of the stepping motor 66, then the slit disk 72 may be used as an index member. The index member may be detected by the photo-interrupter 74 at the reference position.

(First Magnetism Shielding Plate)

Figure 11:
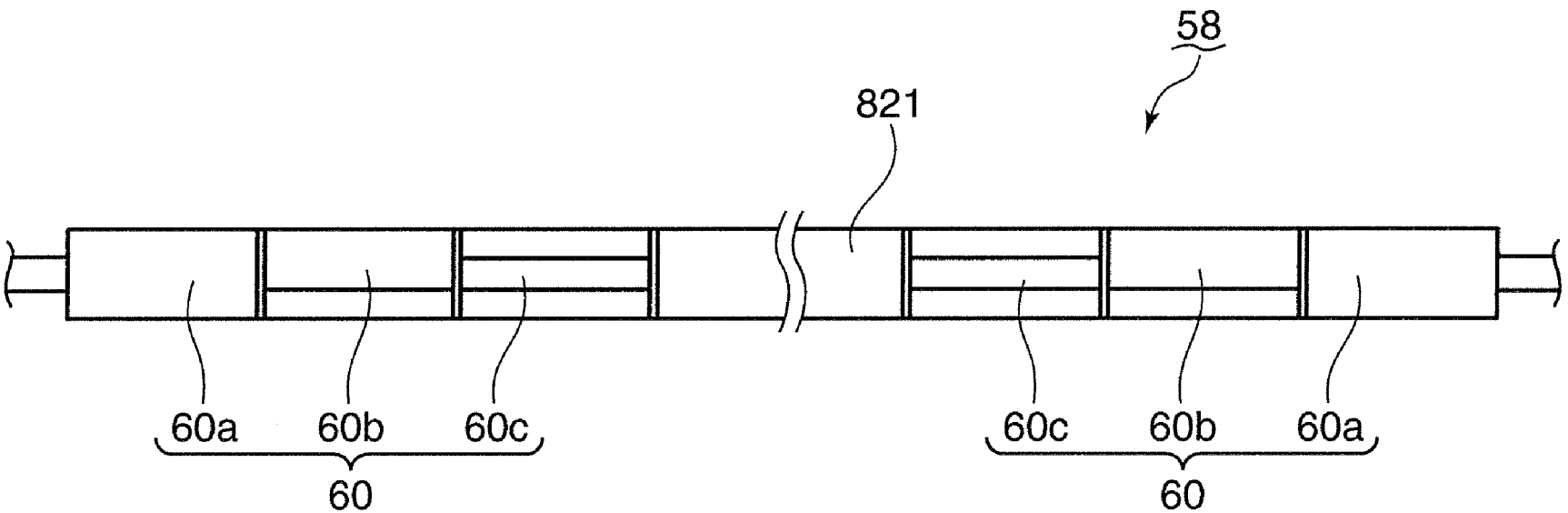
FIG. 11 is a plan view showing arrangement of a first magnetism shielding plate fixed on the center core shown in FIG. 4.

FIG. 11 exemplarily shows arrangement of the first magnetism shielding plate 60.

The magnetic tubular pieces 821 are aligned along the conductive shaft 581 (see FIG. 4). The magnetic tubular pieces 821 in the central portion of the conductive shaft 581 are not covered by the first magnetism shielding plate 60, but the magnetic tubular pieces 821 at both ends of the conductive shaft 581 are externally covered by the first magnetism shielding plate 60. As shown in FIG. 11, the first magnetism shielding plate 60 disposed at either end of the conductive shaft 581 includes three shielding regions 60*a*, 60*b* and 60*c* different in size. The outermost shielding region 60*a* covers the magnetic tubular pieces 821, for example, by approximately 240° of a center angle. The shielding region 60*b* adjacent to the shielding region 60*a* covers the magnetic tube pieces 821, for example, by approximately 180° of a center angle. The innermost shielding region 60*c* adjacent to the shielding region 60*b* covers the magnetic tube pieces 821, for example, by approximately 80° of a center angle. The shielding regions 60*a*, 60*b*, 60*c* are arranged in accordance with width of a sheet passing through the fixing unit 14. Thus, the first magnetism shielding plates 60 cover the magnetic tubular pieces 821 so as to form the shielding regions 60*a*, 60*b* and 60*c* different in size. This allows the center core 58 to rotate in accordance with the width of the sheet passing through the fixing unit 14 so as to restrict excessive heating. The three shielding regions 60*a*, 60*b* and 60*c* may be formed with a single oxygen-free copper plate (or another thinner plate capable of shielding magnetism). Alternatively, the three shielding regions 60*a*, 60*b* and 60*c* may be formed with separate oxygen-free copper plates (or other thinner plates capable of shielding magnetism) (for example, three separate oxygen-free copper plates).

(Principles for Suppressing Excessive Temperature Rise)

Figure 12B:
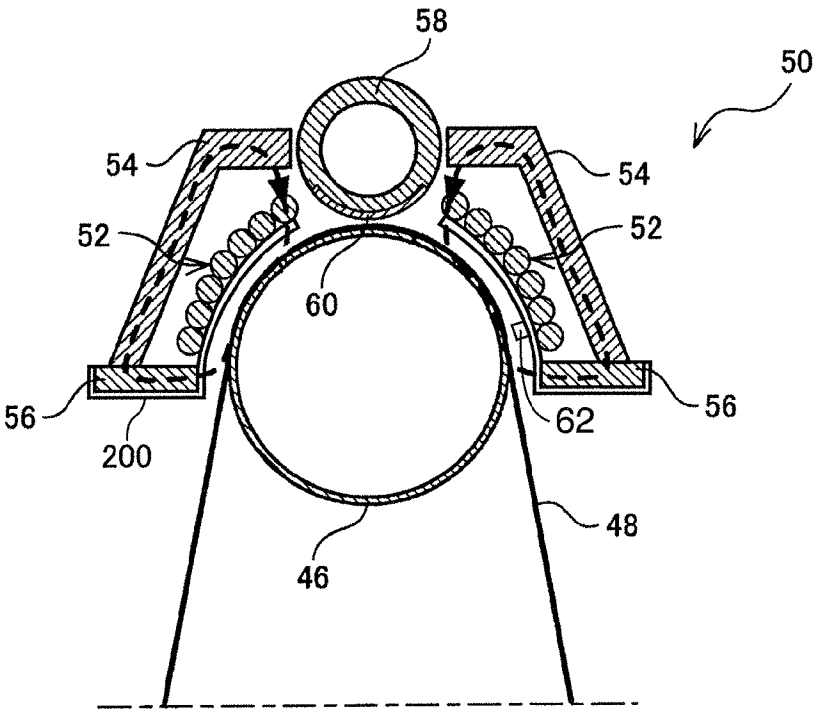
FIG. 12B is a schematic cross-sectional view of the IH coil unit showing the rotation of the center core shown in FIG. 4 to avoid the excessive increase in temperature.
Figure 12A:
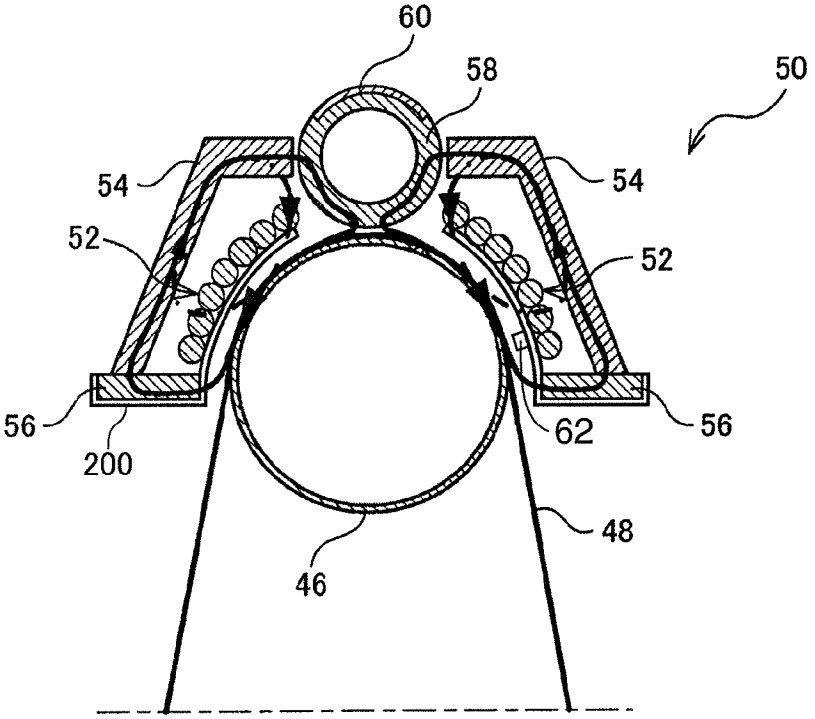
FIG. 12A is a schematic cross-sectional view of the IH coil unit describing rotation of the center core shown in FIG. 4 to avoid excessive increase in temperature.

FIGS. 12A and 12B show action for suppressing excessive temperature rise with the rotation of the center core 58.

FIG. 12A shows a first magnetism shielding plate 60 after displacement to a withdrawn position with the rotation of the center core 58. The magnetic field generated by the induction-heating coil 52 passes through the heat belt 48 and the heat roller 46 along a first path (indicated by the thicker solid lines in FIG. 12A) across the side core 56, the arch core 54 and the center core 58. Consequently, an eddy current is generated in the heat belt 48 and the heat roller 46, which are ferromagnetic bodies. The eddy current results in Joule heat corresponding to an intrinsic resistance of the respective materials. As a result, the heat belt 48 and the heat roller 46 are heated.

FIG. 12B shows a first magnetism shielding plate 60 after displacement to a shielding position. FIG. 12B is a cross-sectional diagram outside a region of the minimum paper passage width W1. As shown in FIG. 12B, the first magnetism shielding plate 60 is disposed across the magnetic path indicated by solid lines in FIG. 12A. The first magnetism shielding plate 60 forms a shielding surface to prevent the magnetic field from traveling along a path toward the heat belt 48 and the heat roller 46 via the center core 58, so that the magnetic path switches to a second path (indicated by thicker dotted lines in FIG. 12B) which does not pass through the center core 58. Thus, heat quantity outside the region of the minimum paper passage width W1 is suppressed. As a result, excessive heating of the heat belt 48 and the heat roller 46 is suppressed.

(Alternative Fixing Units)

Figure 13:
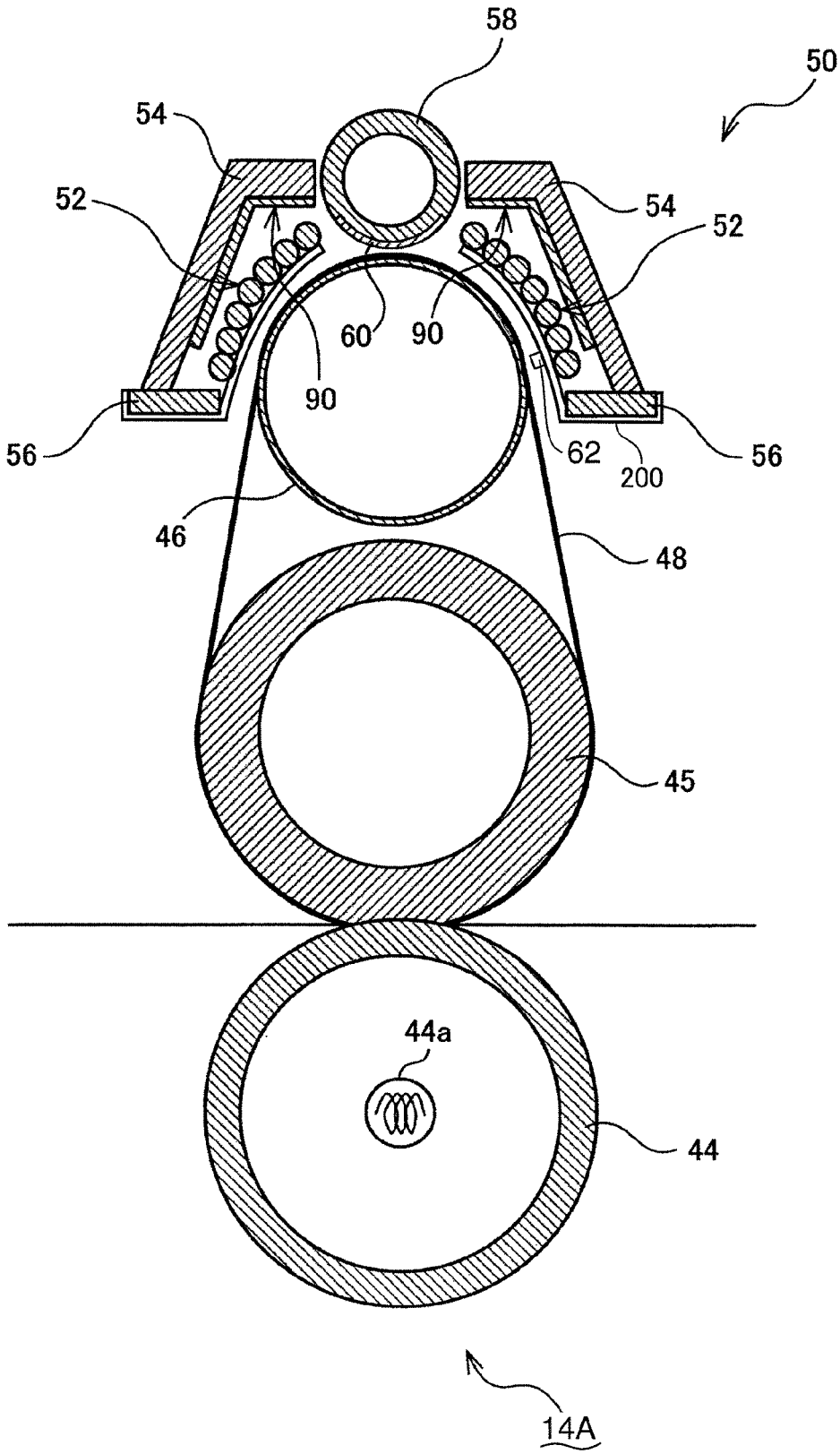
FIG. 13 schematically shows a cross-section of a fixing unit according to an alternative embodiment.

FIG. 13 exemplarily shows a structure of an alternative fixing unit 14A. The fixing unit 14A shown in FIG. 13 has a similar structure to the fixing unit 14 described in the context of FIG. 3, except for the second magnetism shielding plates 90 to be disposed between the arch core 54 and the induction-heating coil 52.

The paired second magnetism shielding plates 90 in left/right symmetry about the coil center of the induction-heating coil 52 are fixed between the arch cores 54 and the induction-heating coil 52 (in this embodiment, on the inner surfaces of the arch cores 54). The second magnetism shielding plates 90 partially (not entirely) cover the inner surface of the arch cores 54. The second magnetism shielding plate 90 is a thinner nonmagnetic and well-conductive plate, which may be preferably made from oxygen-free copper. The entire second magnetism shielding plate 90 is substantially as long as the entire heat roller 46. For example, the second magnetism shielding plate 90 may be 0.5 mm or more preferably from 0.5 mm to 3.0 mm in thickness.

Figure 14B:
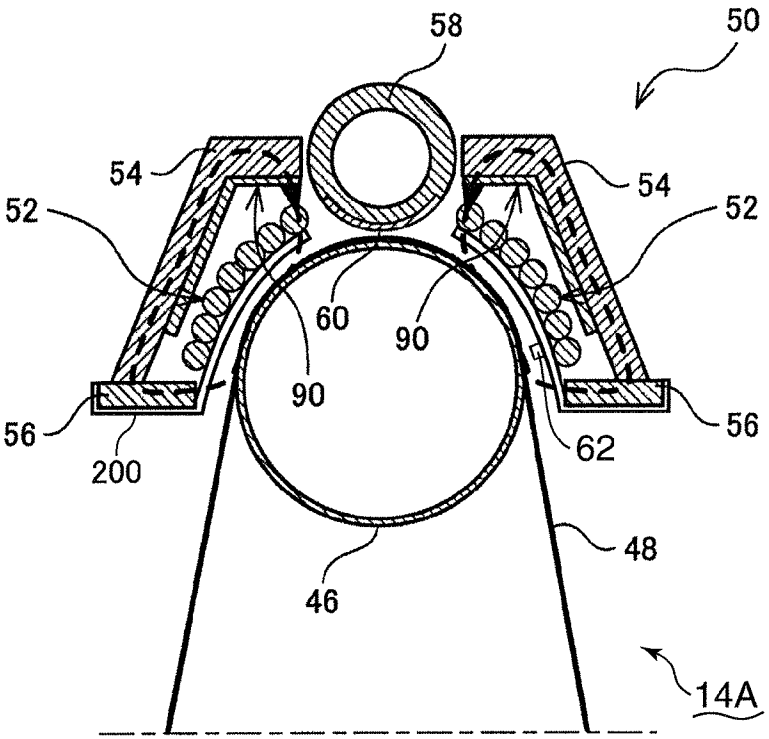
FIG. 14B is a schematic cross-sectional view of the IH coil unit showing the rotation of the center core of the fixing unit shown in FIG. 13 to avoid the excessive increase in temperature.
Figure 14A:
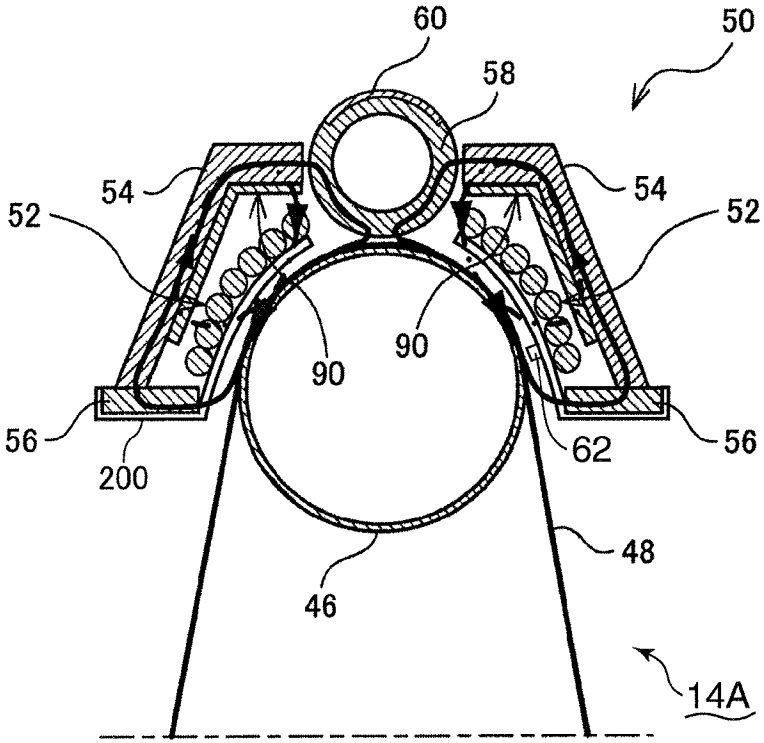
FIG. 14A is a schematic cross-sectional view of an IH coil unit showing rotation of a center core of the fixing unit shown in FIG. 13 to avoid excessive increase in temperature.

FIGS. 14A and 14B show an action to suppress excessive temperature rise with the rotation of the center core 58 in the fixing unit 14A shown in FIG. 13.

FIG. 14A shows a first magnetism shielding plate 60 after displacement to the withdrawn position with the rotation of the center core 58. The magnetic field generated by the induction-heating coil 52 passes through the heat belt 48 and the heat roller 46 via a first path (indicated by thicker solid lines in FIG. 14A) across the side core 56, the arch core 54 and the center core 58. Consequently, an eddy current is generated in the heat belt 48 and the heat roller 46, which are ferromagnetic bodies. The eddy current results in Joule heat corresponding to intrinsic resistance of the respective materials. As a result, the heat belt 48 and the heat roller 46 are heated.

The second magnetism shielding plate 90 shields a short-cut magnetic flux (indicated by the thick dotted lines), which is potentially about to leak from the arch core 54, for example, in an inner side of the magnetic path passing through the heat belt 48 and the heat roller 46 via the side cores 56. This kind of the short-cut magnetic flux, however, is likely to be ignorable enough so that the short-cut magnetic flux hardly contributes to generating heat, and therefore the second magnetism shielding plate 90 is less likely to interfere with full-width heating.

FIG. 14B shows a first magnetism shielding plate 60 after displacement to the shielding position. FIG. 14B is a cross-sectional view outside the region of the minimum paper passage width W1. As shown in FIG. 14B, the first magnetism shielding plate 60 is deployed on the magnetic path indicated by solid lines in FIG. 14A. The first magnetism shielding plate 60 and the second magnetism shielding plates 90 form a shielding surface to prevent the magnetic field from traveling along the path toward the heat belt 48 and the heat roller 46 via the center core 58, so that the magnetic path switches to the second path (indicated by thicker dotted lines in FIG. 14B) which does not pass through the center core 58. Thus heat quantity outside the region of the minimum paper passage width W1 is restricted. As a result, excessive heating of the heat belt 48 and the heat roller 46 is suppressed. Furthermore, while the magnetic path is switched to the second path, the second magnetism shielding plate 90 may shield the magnetic flux which is potentially about to leak from the arch cores 54, thereby supplementing shielding effect of the first magnetism shielding plate 60.

Figure 15:
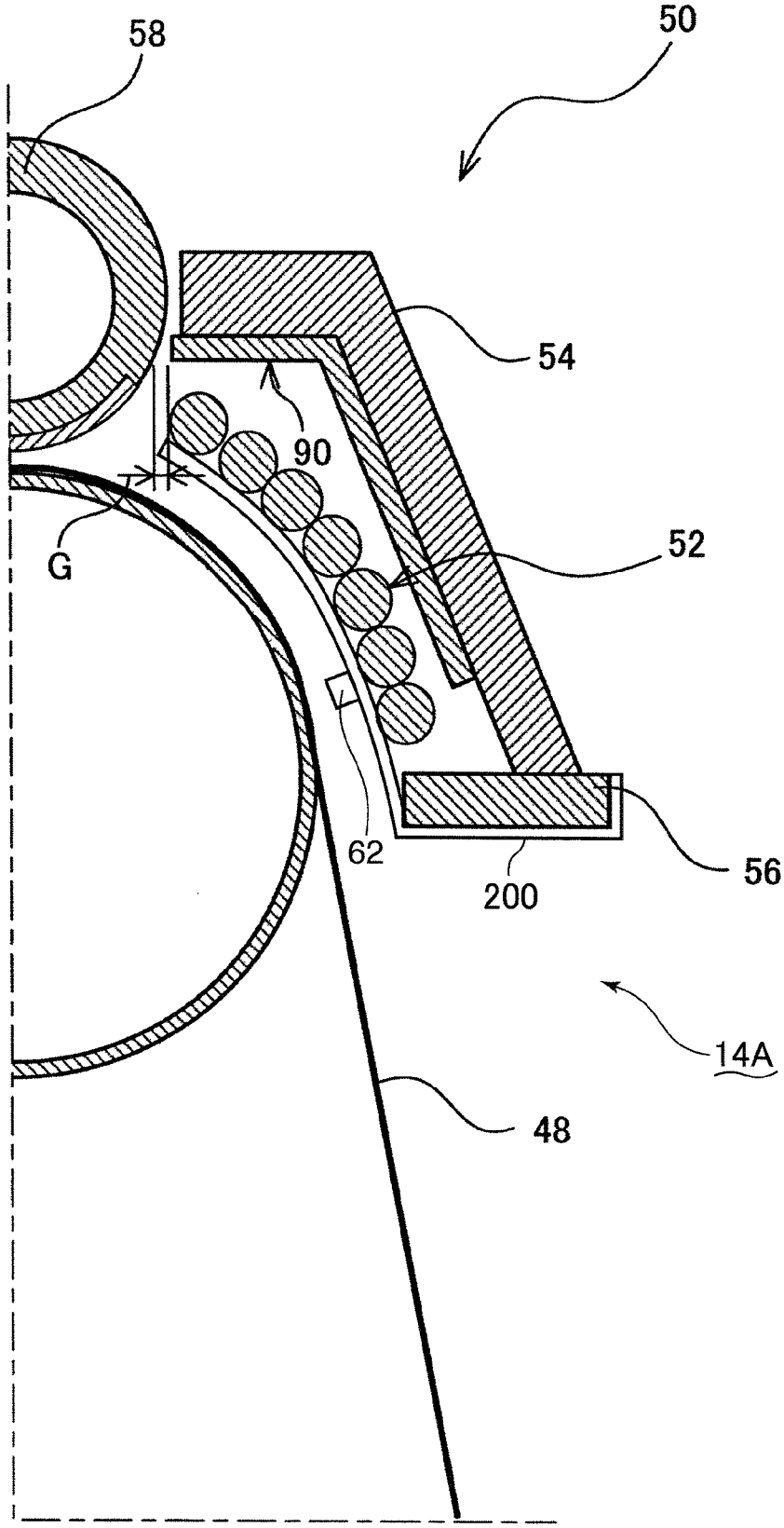
FIG. 15 is a schematic cross-sectional view of the IH coil unit indicating a positional relationship between the center core and the second magnetism shielding plates shown in FIG. 13.

FIG. 15 shows a positional relationship between the center core 58 and the second magnetism shielding plate 90.

Preferably, the second magnetism shielding plate 90 is as close as possible to the center core 58. A gap between an outer circumferential surface of the center core 58 and an edge of the second magnetism shielding plate 90 (see reference numeral G in FIG. 15) is preferably more than 0.5 mm and less than 1 mm.

Figure 16:
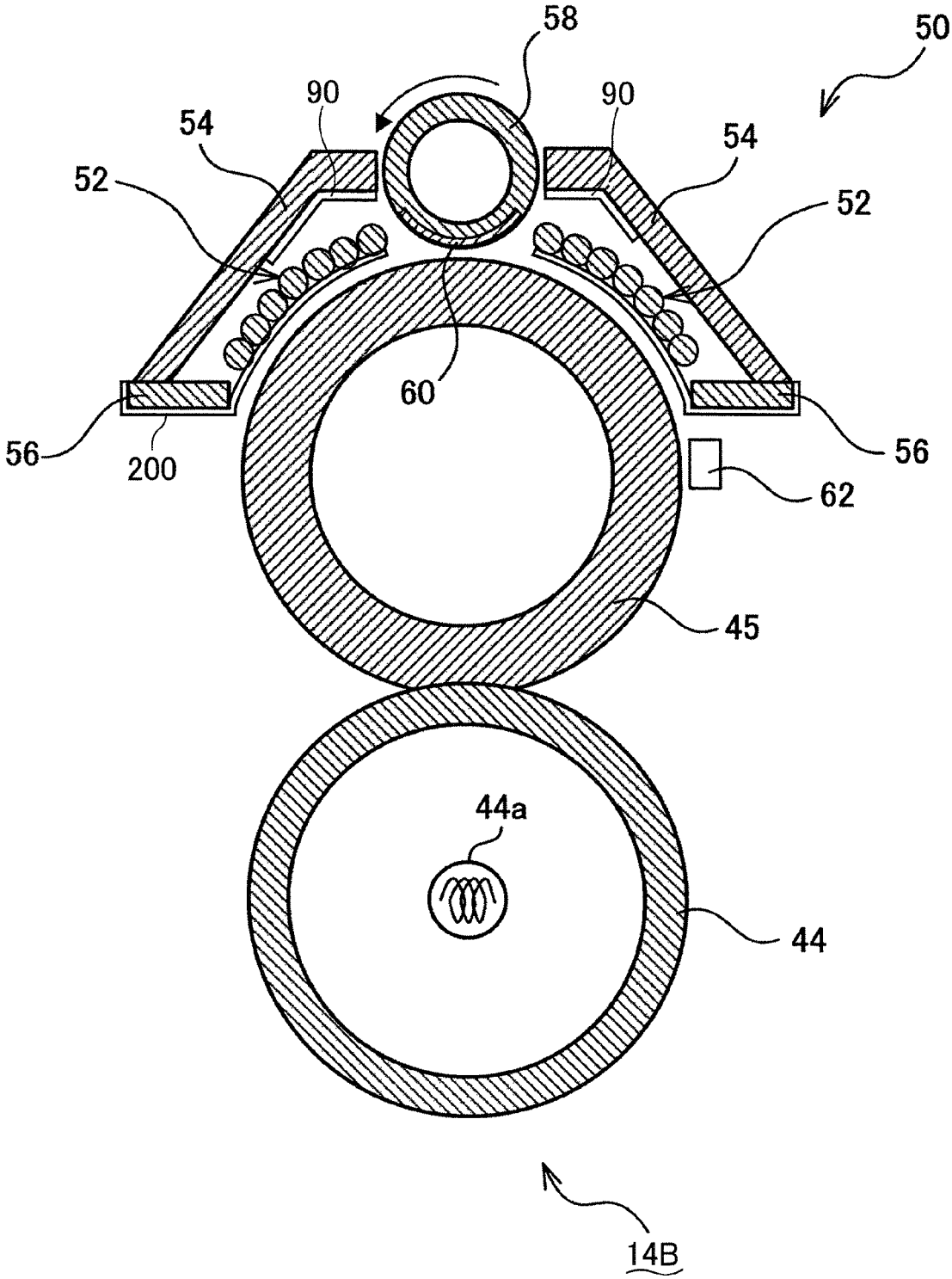
FIG. 16 is a schematic cross-sectional view of a fixing unit according to yet another embodiment.

FIG. 16 exemplarily shows an alternative fixing unit 14B. Unlike the fixing unit 14 shown in FIG. 3, the fixing unit 14B shown in FIG. 16 does not comprise the heat belt. The fixing unit 14B fixes a toner image onto a sheet with the fixing roller 45 and the pressurization roller 44. A magnetic body similar to the heat belt 48 of the fixing unit 14 shown in FIG. 3 is wound around an outer circumference of the fixing roller 45, for example. The magnetic body wound around the outer circumference of the fixing roller 45 is induction-heated by the induction-heating coil 52. The thermistor 62 outside the fixing roller 45 confronts the magnetic layer. The remaining structure is similar to the fixing unit 14 shown in FIG. 3. Furthermore, the second magnetism shielding plates 90 may be placed between the induction-heating coil 52 and the fixing roller 45 or fixed to the inner surface of the arch cores 54.

Figure 17:
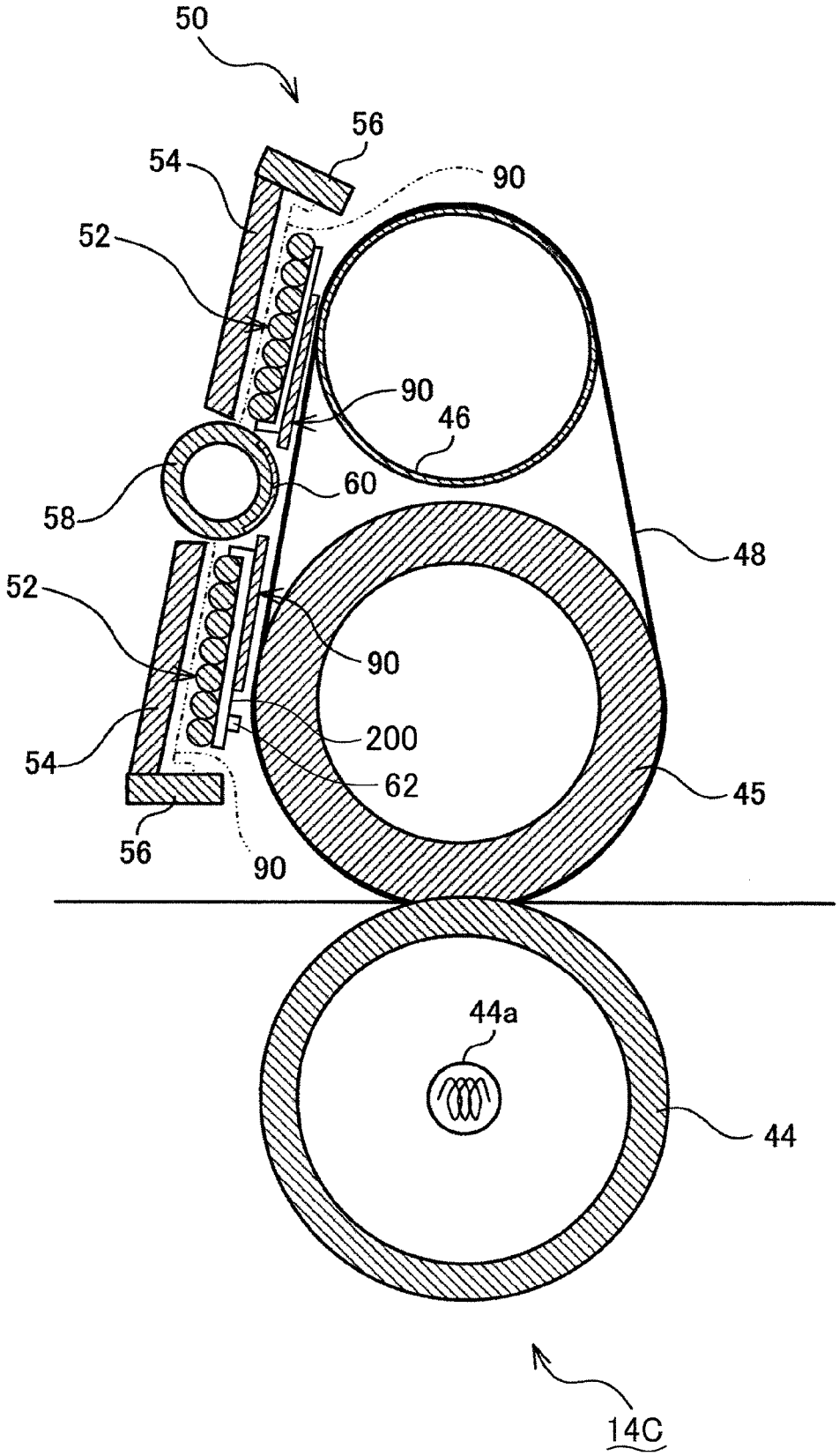
FIG. 17 is a schematic cross-sectional diagram of a fixing unit according to yet another embodiment.

FIG. 17 exemplarily shows an alternative fixing unit 14C. The fixing unit 14C shown in FIG. 17 is configured to induction-heat a flat portion of the heat belt 48 between the heat roller 46 and the fixing roller 45, rather than the arcuate portion of the heat belt 48. The second magnetism shielding plate 90 is flat, rather than curved. For example, the second magnetism shielding plate 90 may be disposed between the induction-heating coil 52 and the heat belt 48, as indicated with solid lines in FIG. 17. Alternatively, the second magnetism shielding plate 90 between the arch core 54 and the induction-heating coil 52 may be fixed along the inner surface of the arch core 54 extending along the planar portion of the heat belt 48, as indicated with double-dotted lines in FIG. 17. The side core 56 of the fixing unit 14C shown in FIG. 17 and the arch core 54 are held by a core holder.

(Alternative Second Magnetism Shielding Plates)

The fixing units 14, 14A, 14B and 14C in the context of the description given above may also be modified in various manners.

Figure 18A:
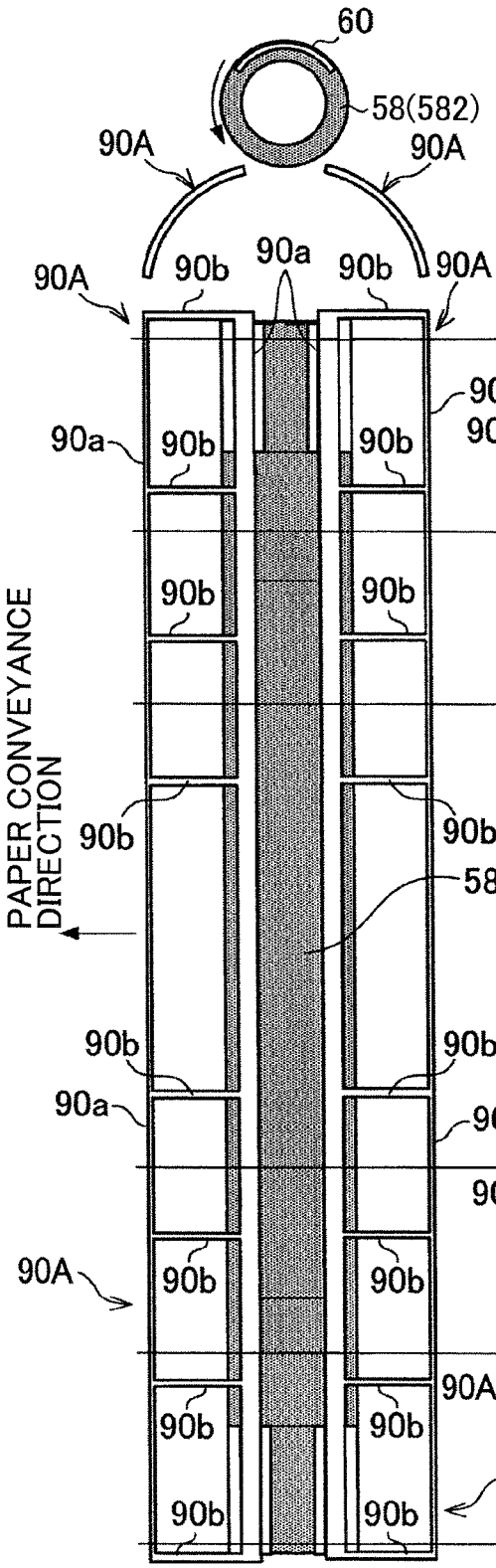
FIG. 18A schematically shows another second magnetism shielding plate.
Figure 18B:
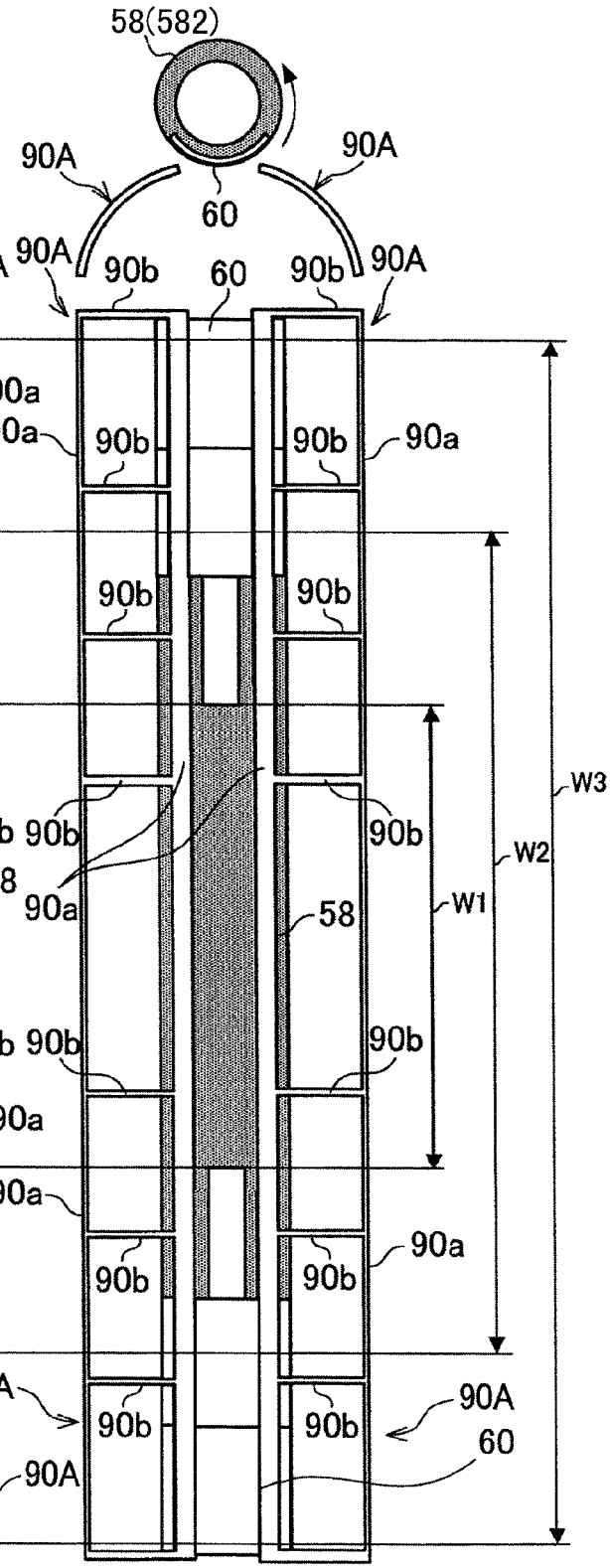
FIG. 18B schematically shows yet another second magnetism shielding plate.

FIGS. 18A and 18B show an alternative structure of second magnetism shielding plates.

The first magnetism shielding plate 60 shown in FIG. 18A is deployed at the withdrawn position outside the magnetic path. The first magnetism shielding plate 60 shown in FIG. 18B after displacement from the withdrawn position shown in FIG. 18A to the shielding position with the rotation of the center core 58.

In the shielding position, the first magnetism shielding plate 60 is disposed inside the magnetic path. The upper drawing in FIGS. 18A and 18B is a side view of the center core 58 and the second magnetism shielding plates 90A. The lower drawing in FIGS. 18A and 18B is a bottom view of the center core 58 and the second magnetism shielding plates 90A. In FIGS. 18A and 18B, an outer surface of the center core 58 (magnetic tube 582) is indicated with a hatched region.

The lower diagrams in FIGS. 18A and 18B show a second magnetism shielding plates 90A including square loops. The square-looped second magnetism shielding plate 90A longitudinally extends along the center core 58. The second magnetism shielding plate 90A may be formed by stamping out the second magnetism shielding plate 90 made from nonmagnetic metal shown in FIG. 13 (for instance, oxygen-free carbon) so as to form and align square-shaped holes. As shown in the upper diagrams in FIGS. 18A and 18B, the second magnetism shielding plate 90A entirely arcs.

The square-shaped loop includes a pair of straight line portions 90*a* longitudinally extending along the center core 58 and a pair of arc portions 90*b* extending in the paper conveyance direction. The second magnetism shielding plate 90A shown in FIGS. 18A and 18B are bonded to a lower surface of the coil supporting section 201.

Each loop of the second magnetism shielding plate 90A, which is longitudinally aligned along the center core 58, independently shows the magnetism shielding effect. Therefore it may be preferable to make the loops corresponded to the paper passage widths W1, W2, W3, respectively.

Figure 19A:
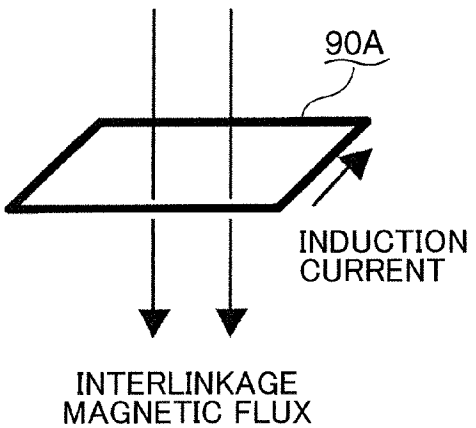
FIG. 19A is a conceptual diagram showing a function of the looped second magnetism shielding plate shown in FIGS. 18A and 18B.
Figure 19B:
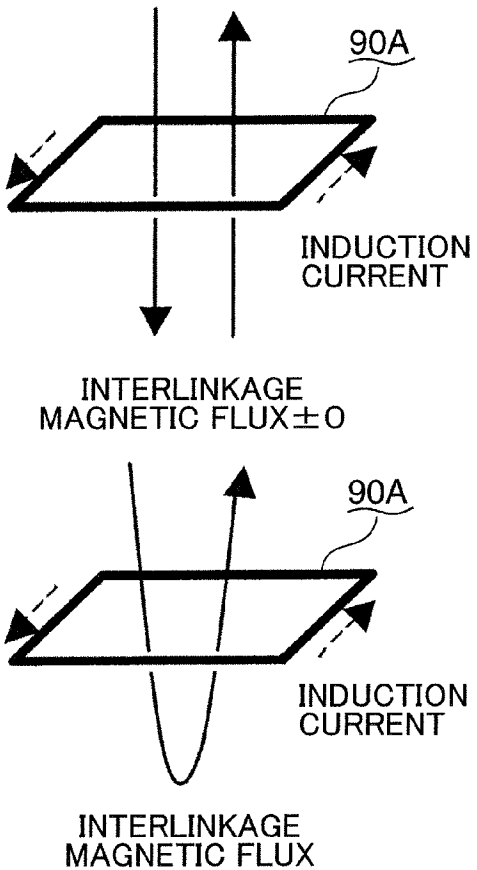
FIG. 19B is a conceptual diagram showing the function of the looped second magnetism shielding plate shown in FIGS. 18A and 18B.
Figure 19C:
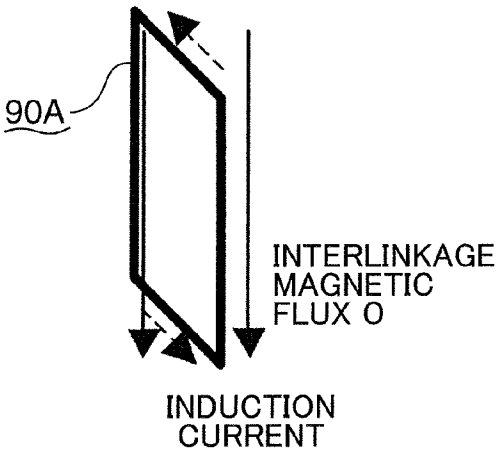
FIG. 19C is a conceptual diagram showing the function of the looped second magnetism shielding plate shown in FIGS. 18A and 18B.

FIGS. 19A to 19C conceptually shows a function of the loop of the second magnetism shielding plate 90A. FIGS. 19A to 19C show one of the loops of the second magnetism shielding plate 90A for clarification of the description. The phenomenon described below may be applied to all of the loops of the second magnetism shielding plate 90A.

FIG. 19A shows a unidirectional penetrating magnetic field (inter-linkage magnetic flux) perpendicularly passing through a surface (virtual plane) of the loop. The inter-linkage magnetic flux generates an induction current flowing along the loop. Due to the electromagnetic induction caused by the induction current, a magnetic field (demagnetizing field) is generated in a reverse direction to the penetrating magnetic field. Consequently, the inter-linkage magnetic flux and the reverse magnetic flux balance out so that the magnetic field is cancelled out. In the present embodiment, when the first magnetism shielding plate 60 is deployed to the shielding position so that the magnetic path is switched to the second path, the second magnetism shielding plate 90A supplement the magnetism shielding effect by means of this magnetic field canceling effect.

Referring to FIG. 19B, the upper drawing shows a bidirectional penetrating magnetic field (inter-linkage magnetic flux) perpendicularly passing through the surface (virtual plane) of the loop. The total inter-linkage magnetic flux (balance) is generally around 0 (±0). In this case, virtually no induction current is generated in the loop of the second magnetism shielding plate 90A. Therefore, each loop is less likely to show any effect to cancel the magnetic field, and so the bidirectional magnetic field just passes through the second magnetism shielding plate 90A. Each loop is also less likely to show any effect to cancel out the magnetic field passing through inside of the loop in a U-turn direction as shown in the lower drawing in FIG. 19B.

If the second magnetism shielding plate 90A includes the loops, the second magnetism shielding plate 90A is less likely to interfere with heat generation as long as balance of magnetic flux flowing out and in the inside of the loops is zero. Consequently, while the first magnetism shielding plate 60 is deployed at the withdrawn position, the second magnetism shielding plate 90A is less likely to affect the magnetic flux U-turning in the loop of the second magnetism shielding plate 90A. Consequently, the second magnetism shielding plate 90A may avoid reduction in the heat generating effect as much as possible.

In FIG. 19C, a magnetic field (inter-linkage magnetic flux) substantially in parallel with the surface of the loop is illustrated. In this case also, similarly to the second magnetism shielding plates 90A shown in FIG. 19B, the induction current is hardly generated in each loop. Consequently, effect to cancel out the magnetic field is less likely to occur.

Figure 20:
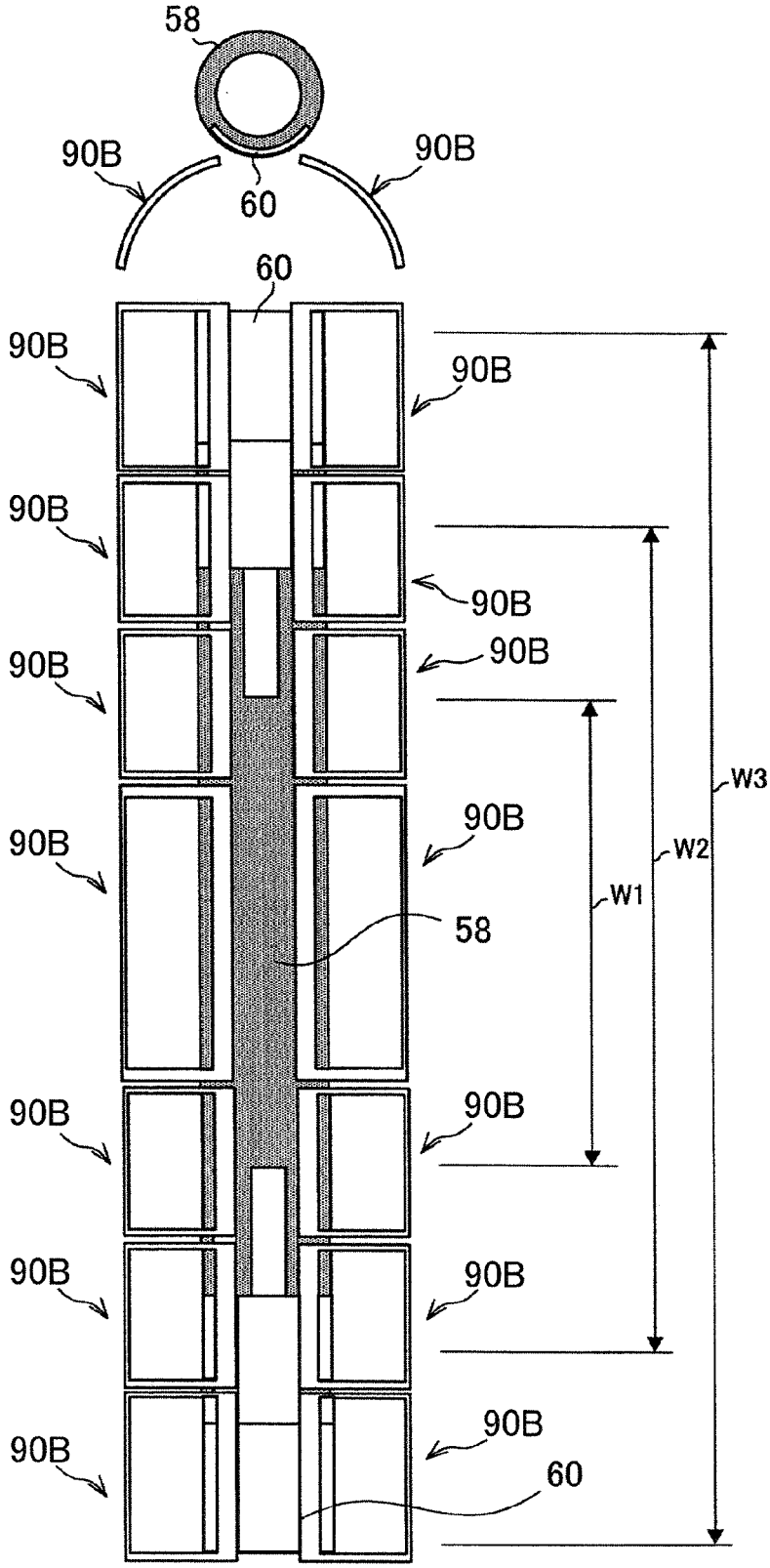
FIG. 20 schematically shows yet another second magnetism shielding plate.

FIG. 20 shows an alternative second magnetism shielding plate 90B. The first magnetism shielding plate 60 shown in FIG. 20 is deployed at the shielding position. The second magnetism shielding plate 90B includes separate loops, which are not electrically connected each other. Furthermore, each loop may correspond to the paper passage widths W1, W2 and W3 different in sheet size. For example, in the case of the minimum sheet size (minimum paper passage width W1), three outer loops per each side of each second magnetism shielding plate 90B (12 loops in total) may provide the shielding magnetism effect. In this case, a stronger magnetic flux does not flow into the inner loops (inside the minimum paper passage width W1) of the second magnetism shielding plates 90B, so that the magnetism shielding effect is hardly produced in these inner loops. Furthermore, if the paper size is ranged from a minimum size to an intermediate size (from the minimum paper passage width W1 to the intermediate paper passage width W2), then two outer loops each side of each second magnetism shielding plate 90B (8 loops in total) may supplement the magnetism shielding effect. In the case of the maximum paper size (maximum paper passage width W3), no induction current is generated in any one of the loops of the second magnetism shielding plates 90B so that the second magnetism shielding plates 90B hardly affect the magnetic field generated by the induction-heating coil 52.

Figure 21:
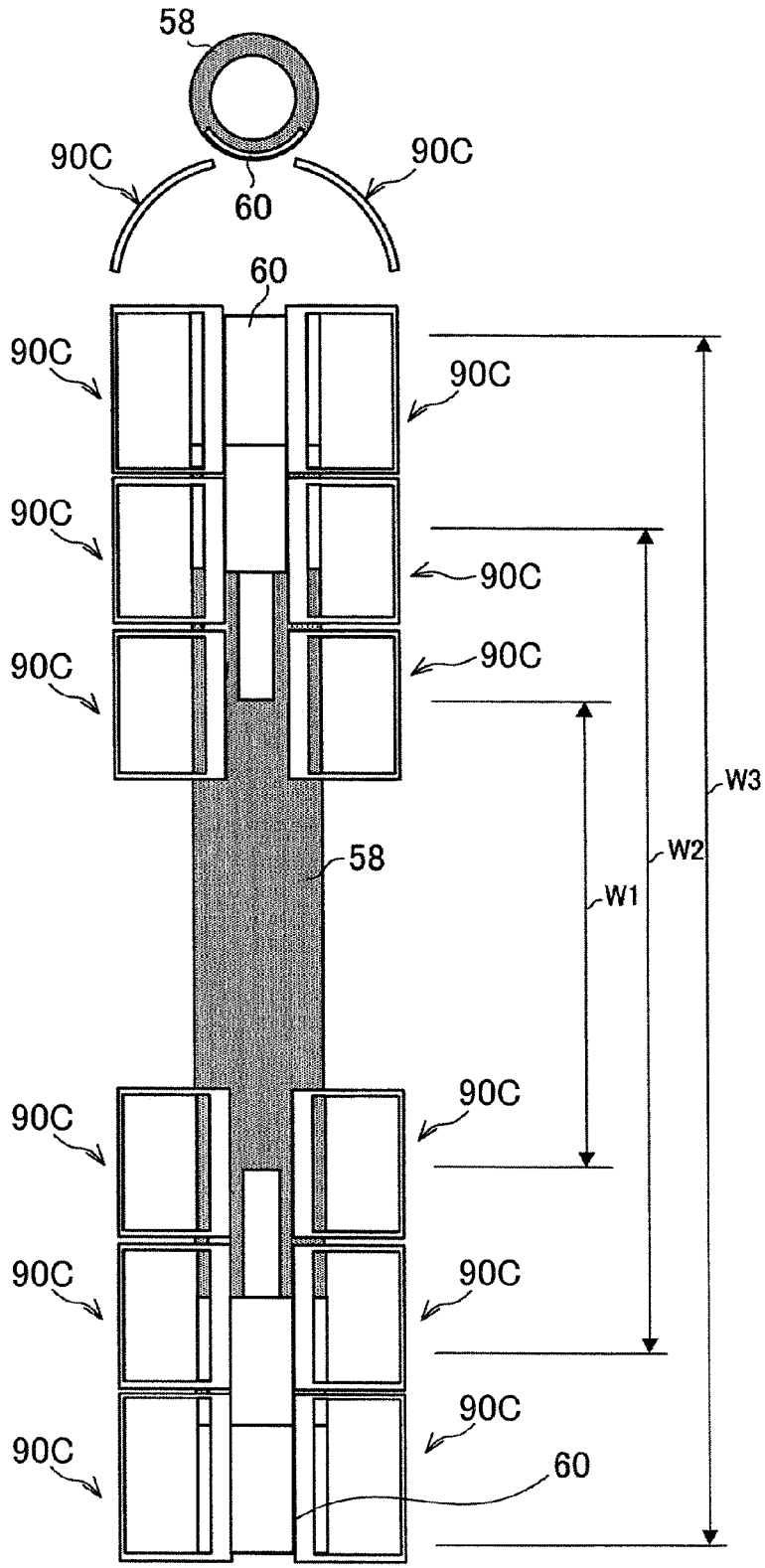
FIG. 21 schematically shows yet another second magnetism shielding plate.

FIG. 21 shows an alternative second magnetism shielding plate 90C. The second magnetism shielding plates 90C shown in FIG. 21 are formed by removing the inner loop of the second magnetism shielding plates 90B inside the minimum paper passage width W1 from the loop group of the second magnetism shielding plates 90B shown in FIG. 20. Apart from this, the second magnetism shielding plates 90C are the same as the second magnetism shielding plates 90B shown in FIG. 20.

Figure 22A:
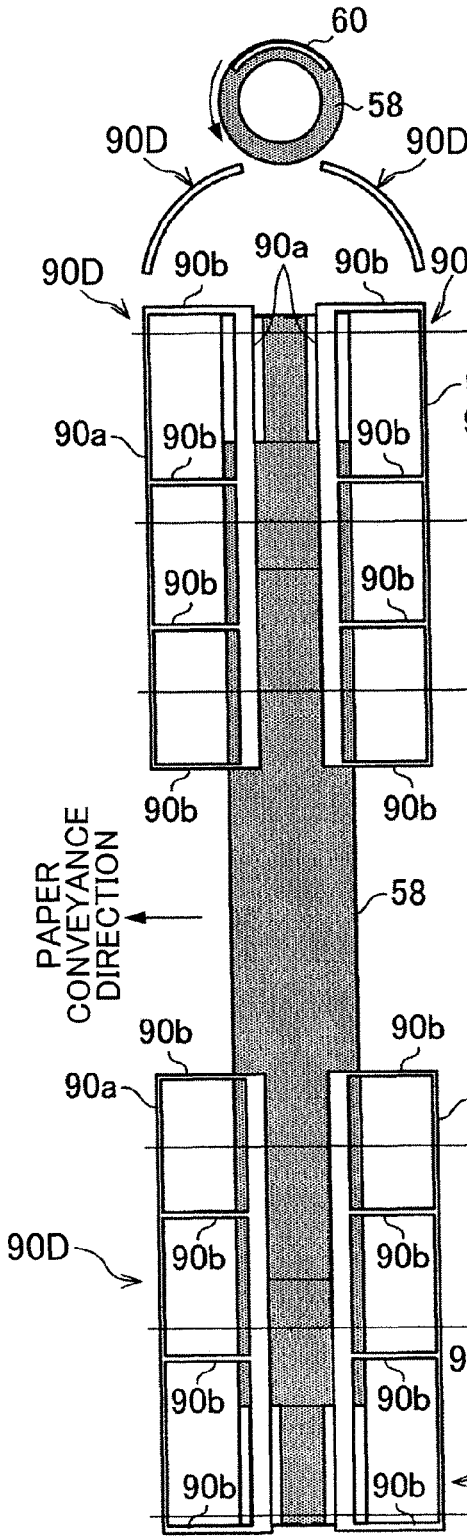
FIG. 22A schematically shows yet another second magnetism shielding plate.
Figure 22B:
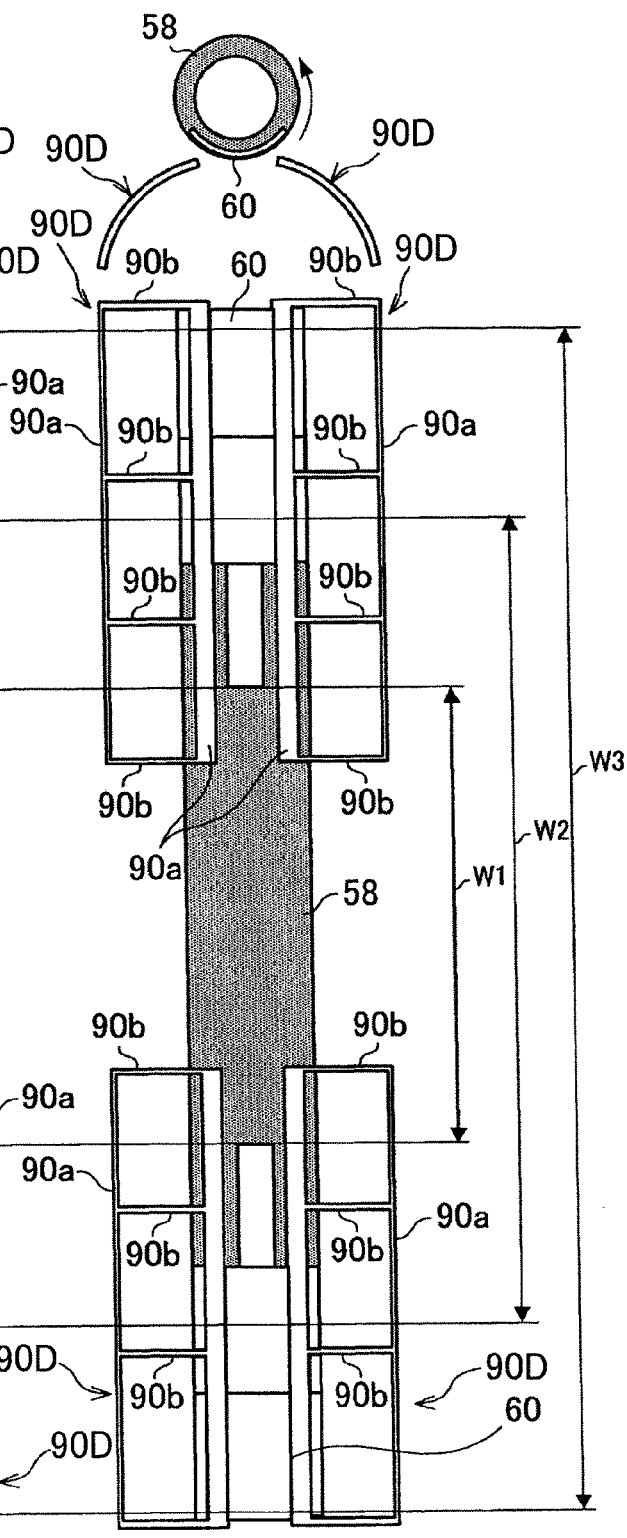
FIG. 22B schematically shows yet another second magnetism shielding plate.

FIGS. 22A and 22B show an alternative second magnetism shielding plates 90D. The second magnetism shielding plate 90D shown in FIGS. 22A and 22B is formed by dividing the second magnetism shielding plate 90A shown in FIGS. 18A and 18B into two pieces to be placed on either outer region of the minimum paper passage width W1, respectively. Apart from this, the second magnetism shielding plate 90D is similar to the second magnetism shielding plate 90A shown in FIGS. 18A and 18B.

A fixing unit according to one aspect of the embodiments described above to fix a toner image onto a sheet passing between a first element and a second element pressed against the first element includes a looped coil surface formed with a coil so that the coil surface generates a magnetic field for induction-heating the first element. The coil surface includes an inner edge defining an opening region. The fixing unit includes an upright wall disposed inside the opening region. An opening is formed in the upright wall. The fixing unit includes a center core disposed along the opening region. The center core includes a conductive shaft and a magnetic tube configured to at least partially cover the conductive shaft. The fixing unit includes a nonconductive cap inserted into the opening. The nonconductive cap partially covers the conductive shaft to electrically insulate the coil from the conductive shaft.

According to the configuration described above, the toner image is fixed on the sheet by heat energy from the first element and pressure energy from the second element. The magnetic field from the looped coil surface formed with the coil arrives at the first element after passing the center core including the magnetic tube disposed in the opening region defined by the inner edge of the coil surface. Consequently, the first element is induction-heated. The center core includes a conductive shaft which is likely to resist deformation such as twisting of the center core. The upright wall disposed in the opening region of which contour is defined by the inner edge of the coil surface supports the nonconductive cap. The nonconductive cap covering the conductive shaft achieves electrical insulation between the coil and the conductive shaft.

Preferably, in the configuration described above, the upright wall may include a first upright wall and a second upright wall facing the first upright wall; the conductive shaft may include a trunk covered with the magnetic tube, a first journal extending from one end of the trunk, and a second journal extending from another end of the trunk; the nonconductive cap may include a first nonconductive cap configured to cover the first journal and a second nonconductive cap configured to cover the second journal; and the first upright wall and the second upright wall may separate the first nonconductive cap and the second nonconductive cap from the coil surface, respectively.

According to the configuration described above, the center core is supported by both the first upright wall and the second upright wall. The conductive first and second journals appear at respective ends of the center core. The first journal and the second journal are covered with the first nonconductive cap and the second nonconductive cap, respectively. This may ensure electrical insulation from the coil. Furthermore, the first upright wall and the second upright wall separate the first nonconductive cap and the second nonconductive cap from the coil surface, respectively. Consequently, the coil surface may be less likely to be damaged.

In the configuration described above, preferably, the fixing unit may further include the third upright wall. The through-hole into which the second nonconductive cap is inserted may be formed in the third upright wall. The coil surface may be formed between the second upright wall and the third upright wall. The second nonconductive cap may bridge over the coil surface between the second upright wall and the third upright wall.

According to the configuration described above, the second nonconductive cap is supported by both the second upright wall and the third upright wall. Consequently, it is suitable to use a long second nonconductive cap.

Preferably, in the configuration described above, the fixing unit may further include: a drive mechanism configured to generate a drive force for rotating the center core; and a gear configured to transmit the drive force to the center core.

According to the configuration described above, the gear may transmit the drive force from the drive mechanism to the center core.

Preferably, in the configuration described above, the gear may be integrally formed with the second nonconductive cap.

According to the configuration described above, the drive force from the drive mechanism is transmitted to the center core via the gear integrally formed together with the second nonconductive cap.

Preferably, in the configuration described above, the gear may be attached to the second nonconductive cap.

According to the configuration described above, the drive force from the drive mechanism is transmitted to the center core via the gear attached to the second nonconductive cap.

Preferably, in the configuration described above, the third upright wall may include a first surface facing the second upright wall, and a second surface opposite the first surface; and the gear may be positioned beside the second surface.

According to the configuration described above, the coil surface is less likely to be damaged by the gear.

Preferably, in the configuration described above, the third upright wall may partially form a gear housing configured to accommodate the drive mechanism.

According to the configuration described above, the third upright wall used as a part of the gear housing may contribute to reduction in size of the fixing apparatus.

Preferably, in the configuration described above, the drive mechanism may include a motor disposed inside the gear housing, and a decelerator connected to the motor in the gear housing; and the gear may engage with the decelerator.

According to the configuration described above, the drive force from the motor in the gear housing is transmitted to the center core via the decelerator.

Preferably, in the configuration described above, the fixing unit may further include a clamping plate configured to clamp the first nonconductive cap to prevent the trunk from shifting toward the first upright wall.

According to the configuration described above, the clamping plate is likely to prevent the center core from shifting in the axial direction. Consequently, projection of the first nonconductive cap from the first upright wall is likely to be kept substantially consistent.

Preferably, in the configuration described above, the first nonconductive cap may include a slide bearing.

According to the configuration described above, the first nonconductive cap is likely to rotatably support the center core.

Preferably, in the configuration described above, the second nonconductive cap may rotate together with the second journal.

According to the configuration described above, the second nonconductive cap is likely to transmit the drive force to the center core.

Preferably, in the configuration described above, the second journal may include a first portion with a noncircular cross-section; and the second nonconductive cap may cover the first portion.

According to the configuration described above, the second nonconductive cap is less likely to slip on the second journal.

Preferably, in the configuration described above, the center core may include a first magnetism shielding plate configured to partially and externally cover a circumferential surface of the magnetic tube.

According to the configuration described above, the heat amount applied to the first element is controlled by means of rotation of the center core. When the first magnetism shielding plate is situated close to the first element, the magnetic field from the center core is more shielded. When the first magnetism shielding plate is distanced from the first element, the magnetic field from the center core is less shielded. Consequently, the heat amount applied to the first element may be adjustable.

Preferably, in the configuration described above, the fixing unit may further include a second magnetism shielding plate disposed between the coil surface and the first element.

According to the configuration described above, the second magnetism shielding plate may enhance heat-suppressive effect.

Preferably, in the configuration described above, the fixing unit may further include a magnetic member. The magnetic member may at least partially surround the first element and the coil surface in combination with the magnetic tube.

According to the configuration described above, the magnetic member guides the magnetic field toward the center core. Consequently, the magnetic field passing through the center core may effectively induction-heat the first element.

In the configuration described above, the fixing unit may further include a second magnetism shielding plate disposed between the magnetic member and the coil surface.

According to the configuration described above, the second magnetism shielding plate may enhance heat-suppressive effect.

The image forming apparatus according to a further aspect of the embodiments described above to form a toner image on a sheet includes a fixing unit configured to fix the toner image on the sheet. The fixing unit includes: a first element; a second element pressed against the first element; and a looped coil surface formed with a coil so that the coil surface generate a magnetic field for induction-heating the first element. The coil surface includes an inner edge defining an opening region. The fixing unit includes an upright wall disposed inside the opening region. An opening is formed in the upright wall. The fixing unit includes a center core disposed along the opening region. The center core includes a conductive shaft and a magnetic tube configured to at least partially cover the conductive shaft. The fixing unit includes a nonconductive cap inserted into the opening. The nonconductive cap partially covers the conductive shaft to electrically insulate the coil from the conductive shaft.

According to the configuration described above, the toner image is fixed on the sheet by heat energy from the first element and pressure energy from the second element. The magnetic field from the looped coil surface formed with the coil arrives at the first element after passing the center core including the magnetic tube disposed in the opening region defined by the inner edge of the coil surface. Consequently, the first element is induction-heated. The center core includes a conductive shaft which is likely to resist deformation such as twisting of the center core. The upright wall disposed in the opening region of which the contour is defined by the inner edge of the coil surface supports the nonconductive cap. The nonconductive cap covering the conductive shaft achieves electrical insulation between the coil and the conductive shaft.

This application is based on Japanese Patent Application Serial No. 2009-200927, filed in Japan Patent Office on Aug. 31, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing unit configured to fix a toner image onto a sheet passing between a first element and a second element pressed against the first element, comprising:

a looped coil surface formed with a coil so that the coil surface generates a magnetic field for induction-heating the first element, the coil surface including an inner edge defining an opening region;

an upright wall disposed inside the opening region, an opening being formed in the upright wall;

a center core disposed along the opening region, the center core including a conductive shaft and a magnetic tube configured to at least partially cover the conductive shaft; and a nonconductive cap inserted into the opening, the nonconductive cap partially covering the conductive shaft to electrically insulate the coil from the conductive shaft.

2. The fixing unit according to claim 1, wherein the upright wall includes a first upright wall and a second upright wall facing the first upright wall;

the conductive shaft includes a trunk covered with the magnetic tube, a first journal extending from one end of the trunk, and a second journal extending from another end of the trunk;

the nonconductive cap includes a first nonconductive cap configured to cover the first journal and a second nonconductive cap configured to cover the second journal; and the first upright wall and the second upright wall separate the first nonconductive cap and the second nonconductive cap from the coil surface, respectively.

3. The fixing unit according to claim 2, further comprising:

a third upright wall, the second nonconductive cap inserted into a through-hole formed in the third upright wall, wherein the coil surface is formed between the second upright wall and the third upright wall; and The second nonconductive cap bridges over the coil surface between the second upright wall and the third upright wall.

4. The fixing unit according to claim 3, further comprising:

a drive mechanism configured to generate a drive force for rotating the center core; and a gear configured to transmit the drive force to the center core.

5. The fixing unit according to claim 4, wherein the gear is integrally formed with the second nonconductive cap.

6. The fixing unit according to claim 4, wherein the gear is attached to the second nonconductive cap.

7. The fixing unit according to claim 4, wherein

The third upright wall includes a first surface facing the second upright wall, and a second surface opposite the first surface; and the gear is positioned beside the second surface.

8. The fixing unit according to claim 7, wherein the third upright wall partially forms a gear housing configured to accommodate the drive mechanism.

9. The fixing unit according to claim 8, wherein the drive mechanism includes a motor disposed inside the gear housing, and a decelerator connected to the motor in the gear housing; and the gear engages with the decelerator.

10. The fixing unit according to claim 2, further comprising: a clamping plate configured to clamp the first nonconductive cap so that the clamping plate prevents the trunk from shifting toward the first upright wall.

11. The fixing unit according to claim 2, wherein the first nonconductive cap includes a slide bearing.

12. The fixing unit according to claim 2, wherein the second nonconductive cap rotates together with the second journal.

13. The fixing unit according to claim 12, wherein the second journal includes a first portion with a noncircular cross-section; and the second nonconductive cap covers the first portion.

14. The fixing unit according to claim 1, wherein the center core includes a first magnetism shielding plate configured to partially and externally cover a circumferential surface of the magnetic tube.

15. The fixing unit according to claim 14, further comprising: a second magnetism shielding plate disposed between the coil surface and the first element.

16. The fixing unit according to claim 14, further comprising: a magnetic member configured to at least partially surround the first element and the coil surface in combination with the magnetic tube.

17. The fixing unit according to claim 16, further comprising: a second magnetism shielding plate disposed between the magnetic member and the coil surface.

18. An image forming apparatus configured to form a toner image on a sheet, comprising:

a fixing unit configured to fix the toner image on the sheet, wherein the fixing unit includes:

a first element;

a second element pressed against the first element;

a looped coil surface formed by a coil so that the coil surface generates a magnetic field for induction-heating the first element, the coil surface including an inner edge defining an opening region;

an upright wall disposed inside the opening region, an opening being formed in the upright wall;

a center core disposed along the opening region, the center core including a conductive shaft and a magnetic tube configured to at least partially cover the conductive shaft; and a nonconductive cap inserted into the opening, the nonconductive cap partially covering the conductive shaft to electrically insulate the coil from the conductive shaft.

* * * * *